US007127929B2

(12) United States Patent
Akahane et al.

(10) Patent No.: US 7,127,929 B2
(45) Date of Patent: Oct. 31, 2006

(54) FORGING WORK METHOD

(75) Inventors: Fujio Akahane, Nagano (JP); Nagamitsu Takashima, Nagano (JP); Kazushige Hakeda, Nagano (JP); Ryoji Uesugi, Nagano (JP); Akiharu Kurebayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 59 days.

(21) Appl. No.: 10/647,115

(22) Filed: Aug. 25, 2003

(65) Prior Publication Data

US 2004/0107759 A1 Jun. 10, 2004

(30) Foreign Application Priority Data

Aug. 23, 2002 (JP) ..... P2002-243481
Aug. 19, 2003 (JP) ..... P2003-295584

(51) Int. Cl.
*B21D 28/32* (2006.01)
*B21J 5/06* (2006.01)

(52) U.S. Cl. ..... 72/334; 72/356; 72/403

(58) Field of Classification Search ..... 72/334, 72/335, 407, 355.6, 333, 355.4, 356, 339, 72/403

See application file for complete search history.

(56) References Cited

U.S. PATENT DOCUMENTS 438,364 A * 10/1890 Taliaferro ..... 72/331
1,849,670 A * 3/1932 Glasner et al. ..... 72/336
2,954,068 A * 9/1960 Williamson ..... 72/397
3,434,327 A * 3/1969 Speakman ..... 72/377
3,650,142 A * 3/1972 Baldwin et al. ..... 72/403
3,962,899 A * 6/1976 Hubbell ..... 72/334
4,356,717 A * 11/1982 Okunishi et al. ..... 72/342.3
4,711,115 A * 12/1987 Sukonnik et al. ..... 72/329
4,809,532 A * 3/1989 Tanaka et al. ..... 72/337
5,125,255 A * 6/1992 Brown et al. ..... 72/334
6,490,790 B1 * 12/2002 Soga et al. ..... 29/888.09
6,775,908 B1 * 8/2004 Ohara et al. ..... 29/888.1

FOREIGN PATENT DOCUMENTS

JP 06-008429 1/1994
JP 06-126367 5/1994
JP 06-238895 8/1994
JP 06-269869 9/1994
JP 09-155469 6/1997

* cited by examiner

*Primary Examiner*—Daniel C. Crane
(74) *Attorney, Agent, or Firm*—Sughrue Mion, PLLC

(57) ABSTRACT

A metallic plate member is provided. A first punch is operable to perform a first forging work to mold a first member in the plate member. The first member has a first function. A second punch is operable to perform a second forging work to mold a second member in the plate member. The second member including at least one kind of positioning member. The first forging work and the second forging work are performed at a single stage.

19 Claims, 26 Drawing Sheets

FORGING WORK METHOD

BACKGROUND OF THE INVENTION

The present invention relates to a forging work method used in manufacturing parts to be incorporated in a liquid ejection head or the like. The present invention also relates to a method of manufacturing a liquid ejection head using such a forging work method.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber. Such a structure is disclosed in Japanese Patent Publication No. 2000-263799A, for example.

In the related-art recording head, since the thickness of the partition wall is very thin, a close attention has been paid to obtain the recessed shape of the pressure generating chambers exactly. However, in a case where a plate-shaped member such as a chamber formation plate in which the pressure generating chambers are formed is joined to the other elastic plate and nozzle plate, positioning structure for assembly must be provided with high accuracy in connection with the pressure generating chambers. Particularly, in a case where this positioning structure is manufactured by forging work, measure to counter a deformation phenomenon produced in metal material is required.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

SUMMARY OF THE INVENTION

It is therefore an object of the invention to rationally provide a positioning structure for assembly to be used with a forging work for forming recesses in a plate member with high accuracy.

In order to achieve the above object, according to the invention, there is provided a forging work method, comprising steps of:

providing a metallic plate member;

providing a first punch, operable to perform a first forging work to mold a first member in the plate member;

providing a second punch, operable to perform a second forging work to mold a second member in the plate member;

actuating the first punch up to a maximum stroke position thereof, while molding the first member; and actuating the second punch, while keeping the first punch at the maximum stroke position.

With such a configuration, the first punch stopping in the maximum stroke position is being pushed into the position where the first member have been molded. In this state, the flow of the metal material is completed, and the stress with the flow is also completely eliminated. After the influence on the vicinity of the circumference produced in molding of the first member is eliminated, the second punch is operated to perform the second forging work. Therefore, on the way of or in completion of the second forging working, the second member is molded without receiving any external force. Accordingly, the first member and the second member are held in the desired positional relationship, and the plural kinds of worked portions having high accuracy can be obtained.

On the other hand, when the second punch performs the second forging work, the first punch remains entering into the plate member. Therefore, even in a case where the flow of the metal material produced in the second forging work and the stress with the flow are given to the first member, the first punch serves as a base member such as a core bar, so that it is possible to prevent such a harmful influence as to deform the first member.

Preferably, the first member has a higher minuteness than the second member. In this case, the first member, which are difficult to enhance the molding accuracy, are first worked and thereafter the second member is molded. Since the working state of the worked portion having the high minuteness is determined in the maximum stroke position of the first punch and then the second forging work with the low minuteness is carried out, molding quality of the worked portion having the high minuteness can be secured at the desired level.

Preferably, the first forging work and the second forging work are performed on a single stage. In this case, the relative position of each worked portion is exactly obtained. Namely, since the first punch and the second punch are pressed on the static plate member, the plate member does not move while each worked portion is molded, so that the positional relation among the respective worked portions can be exactly set. Further, the number of working steps can be reduced, which is advantageous in manufacturing cost.

Preferably, the second forging work is a perforating work. Although the flowing amount of the metal material and the stress with its flow become large in such a perforating work, since the molding state of the first member is stable, they do not give a bad influence to the worked portion of the first member.

Preferably, the second member comprises at least a positioning member to be used when the plate member is assembled with another member. Since factors of deviating the position and shape of the positioning member are eliminated as described above, the positioning member is formed in the proper position and in the predetermined shape, so that a positioning function of high accuracy is fulfilled.

Preferably, the first forging work includes a first work for preforming the first member and a second work for finishing the first member. Here, the second forging work is performed after the second work of the first forging work. In the second work for finishing, since the flow of the material and the stress with its flow have been already produced in the first work for preforming, the flow of the material and occurrence of the stress with its flow are reduced greatly, and in the subsequent working, quantity of working is small or working is not performed at all. Therefore, a bad influence on formation of the second member can be reduced up to a level which does not matter practically.

According to the invention, there is also provided a forging work method, comprising steps of:

providing a metallic plate member;

providing a first punch, operable to perform a first forging work to mold a first member in the plate member, the first member has a first function; and providing a second punch, operable to perform a second forging work to mold a second member in the plate member, the second member has a second function different from the first function;

wherein the first forging work and the second forging work are performed at a single stage.

With such a configuration, the relative position of each worked portion is exactly obtained. Namely, since the first punch and the second punch are pressed on the static plate member, the plate member does not move while each worked portion is molded, so that the positional relation among the respective worked portions can be exactly set. Further, the number of working steps can be reduced, which is advantageous in manufacturing cost.

The term "stage" will be described with progressive working as an example. The plate member progresses in the forging machine, and when the plate member stops in the forging machine, the punches are actuated to perform the forging works. The "single stage" comprehensively means the plastic working performed while the metal material plate stops. However, it is not limited to the progressive working.

Further, since the positioning member is formed in the proper position and in the proper shape, the relative position with another member is determined exactly, so that quality of assembly having high accuracy can be secured.

Preferably, the first member is molded before the second member is molded. In this case, the first punch stopping in the maximum stroke position is being pushed into the position where the first member have been molded. In this state, the flow of the metal material is completed, and the stress with the flow is also completely eliminated. After the influence on the vicinity of the circumference produced in molding of the first member is eliminated, the second punch is operated to perform the second forging work. Therefore, on the way of or in completion of the second forging working, the second member is molded without receiving any external force. Accordingly, the first member and the second member are held in the desired positional relationship, and the plural kinds of worked portions having high accuracy can be obtained.

Here, it is preferable that: the first punch is first actuated up to a maximum stroke position thereof, while molding the first member; and the second punch is actuated, while keeping the first punch at the maximum stroke position.

It is further preferable that: the first forging work includes a first work for preforming the first member and a second work for finishing the first member; and the second forging work is performed after the second work of the first forging work.

Here, it is preferable that the first member is provided as recesses, and the positioning member is provided as at least two through holes. In this case, upon the assembly, the positioning function can be fulfilled with such a method that a positioning pin of an assembly jig is caused to pass through the through holes, so that the positioning accuracy can be secured with a simple configuration. Further, since the plate member is restricted at two points by the two positioning members, the assembled members do not shift in any direction.

It is further preferable that the recesses are arranged at a fixed pitch, for example, which is 0.3 mm or less. The invention is preferably applicable to a case in which such minute members are molded with the forging work.

Preferably, the metallic plate member is comprised of nickel. In this case, such good effects are obtained that a phenomenon of heat expansion and contraction is good in alignment with other parts since coefficient of linear expansion of nickel itself is low, rust resistance is good, and malleability that is important for the forging work is rich.

Preferably, the first member and the second member are arranged as close as possible. In this case, the displacement amount of the position of the second member due to temperature change can be minimized, and accuracy in assembly can be more enhanced. Namely, since the amount of the plate member between the first member and the second member becomes small, the change amount of the relative position between the first member and the second member due to the temperature change is reduced up to a level that does not matter.

According to the invention, there is also provided a method of manufacturing a liquid ejection head in which the plate member subjected to the above forging work method is incorporated, the method comprising steps of:

perforating a through hole at a bottom of each of the recesses;

joining a sealing plate to the plate member so as to seal the recesses to form a plurality of pressure generating chambers, while using the positioning member; and joining a metallic nozzle plate formed with a plurality of nozzles, such that each of the nozzles is communicated with associated one of the pressure generating chambers via the through hole, while using the positioning member.

In this case, the plate member is incorporated in the liquid ejection head as a chamber formation plate. Since the plate member can be assembled with the sealing member and the nozzle plate with high accuracy, excellent liquid ejection property can be secured.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
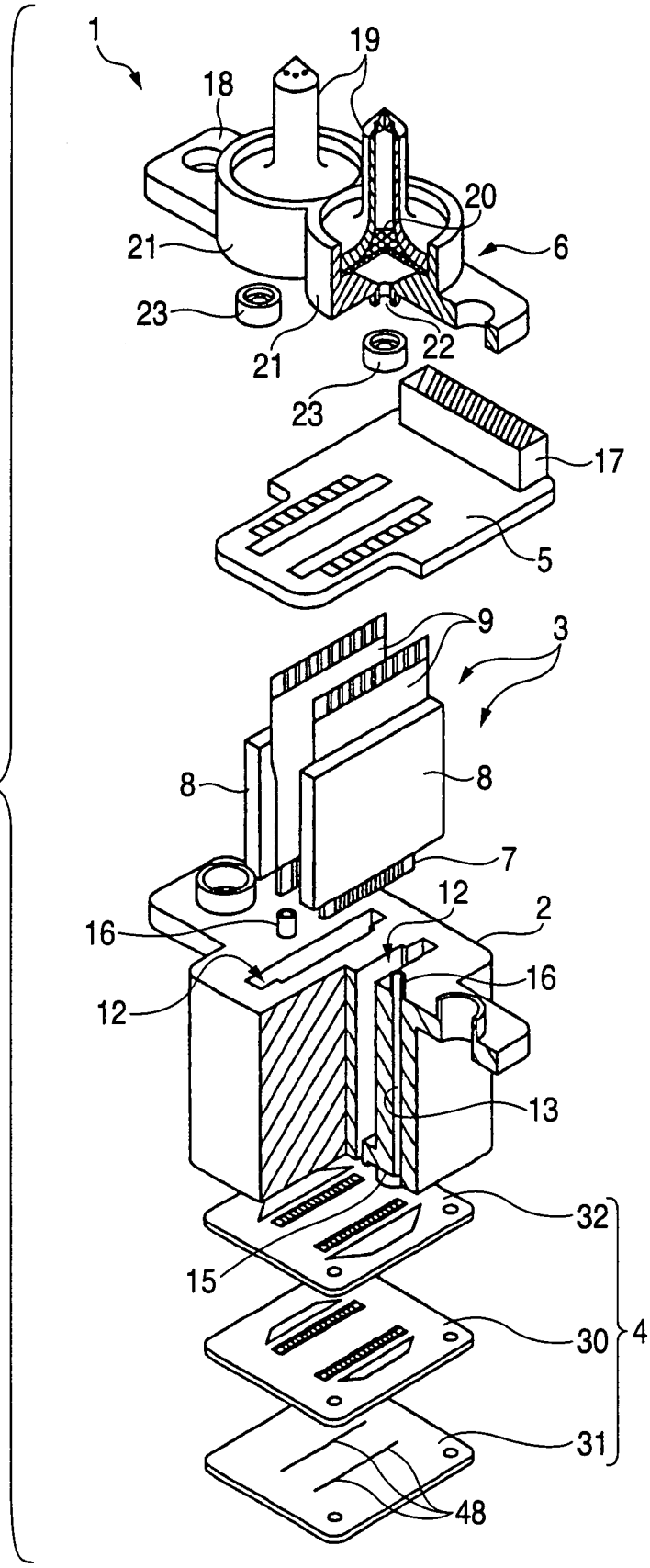
FIG. 1 is a perspective view of a disassembled ink jet recording head according to a first example.
Figure 2:
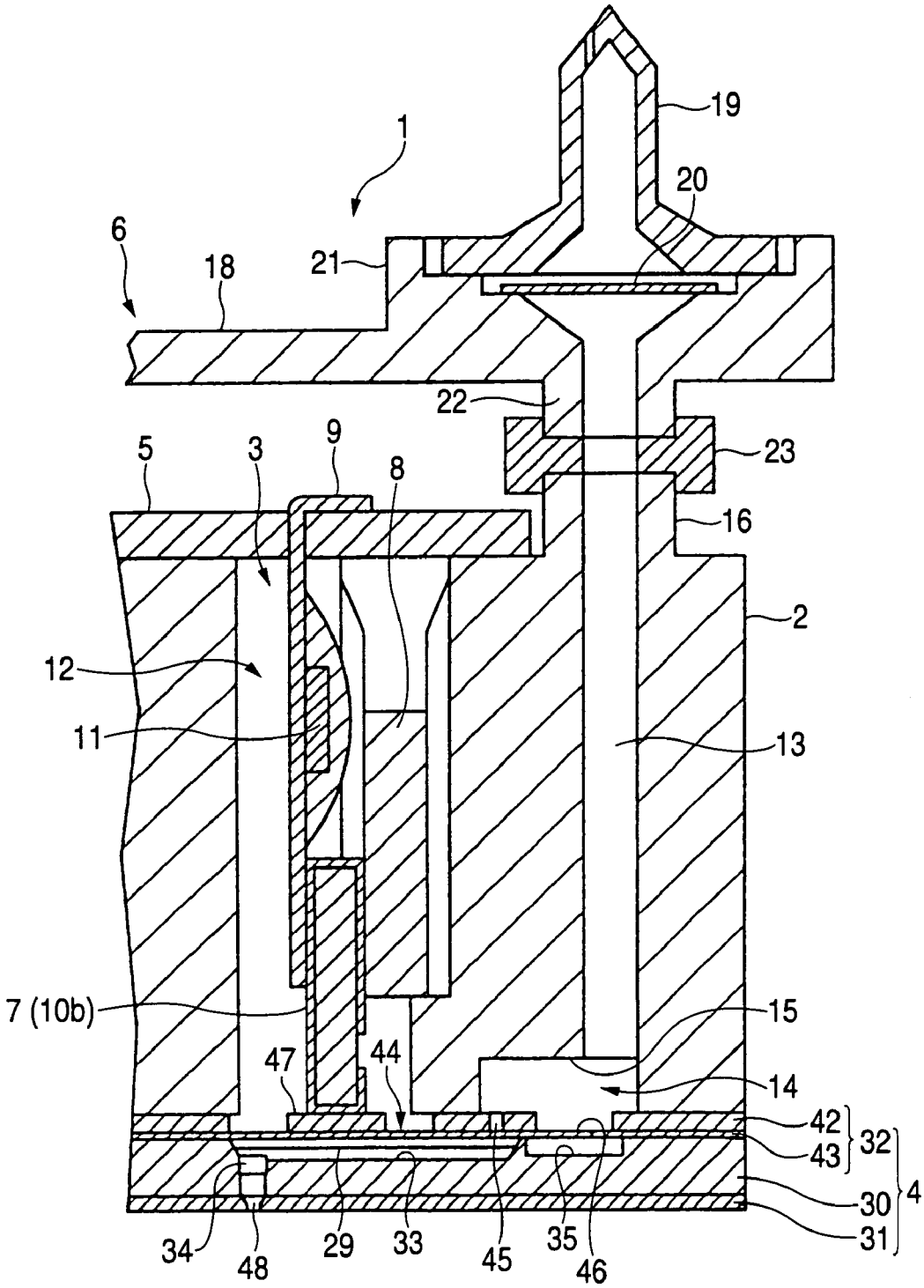
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
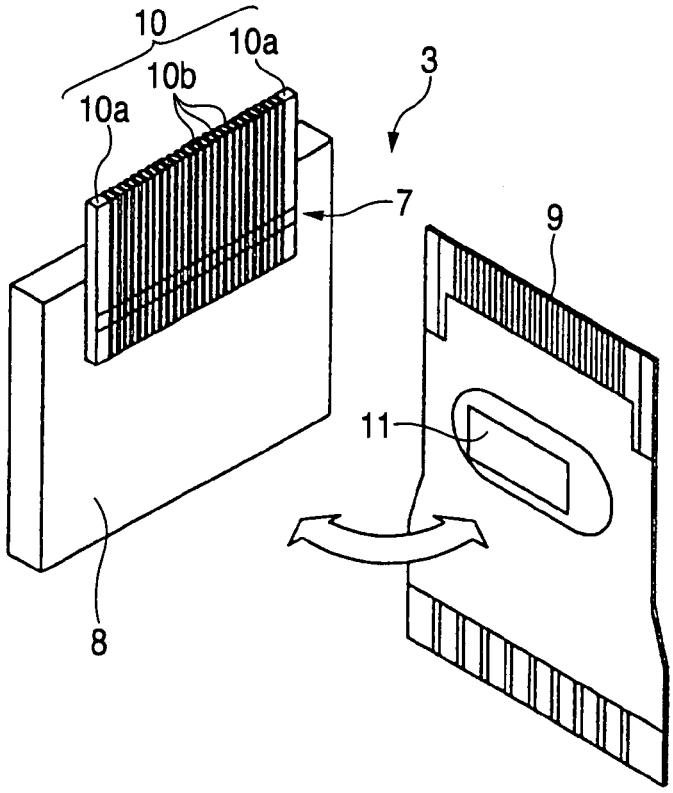
FIGS. 3A and 3B are views for explaining a vibrator unit.
Figure 3B:
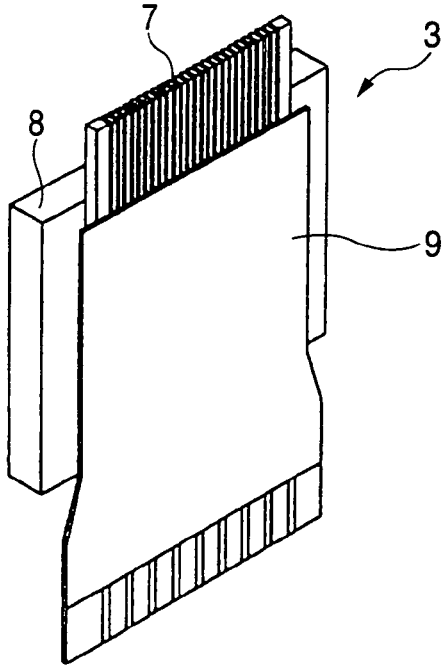

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
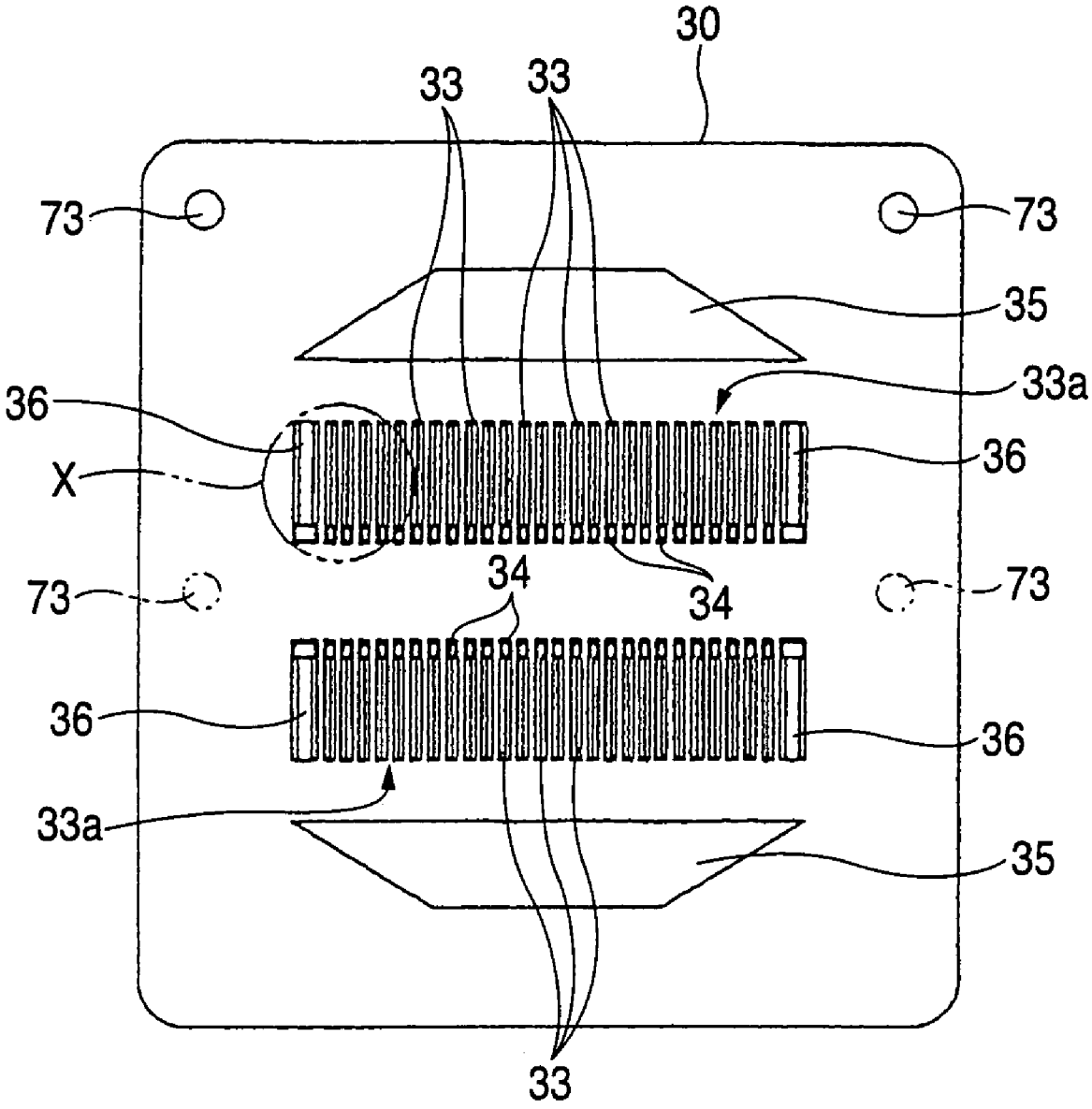
FIG. 4 is a plan view of a chamber formation plate.

As shown in FIG. 4, the chamber formation plate 30 is a plate-like member made of a metal formed with elongated recess portions 33, a communicating port 34 formed in each elongated recess portion 33 and spaces 35 for constituting the common ink reservoir 14 (hereinafter, referred as "reservoir space 35"). Each reservoir space 35 penetrates the chamber formation plate 30 while extending along a direction in which the elongated recess portions 33 are arranged. Such a reservoir space 35 will be shown later in drawings for explaining the working process, as a punched portion. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
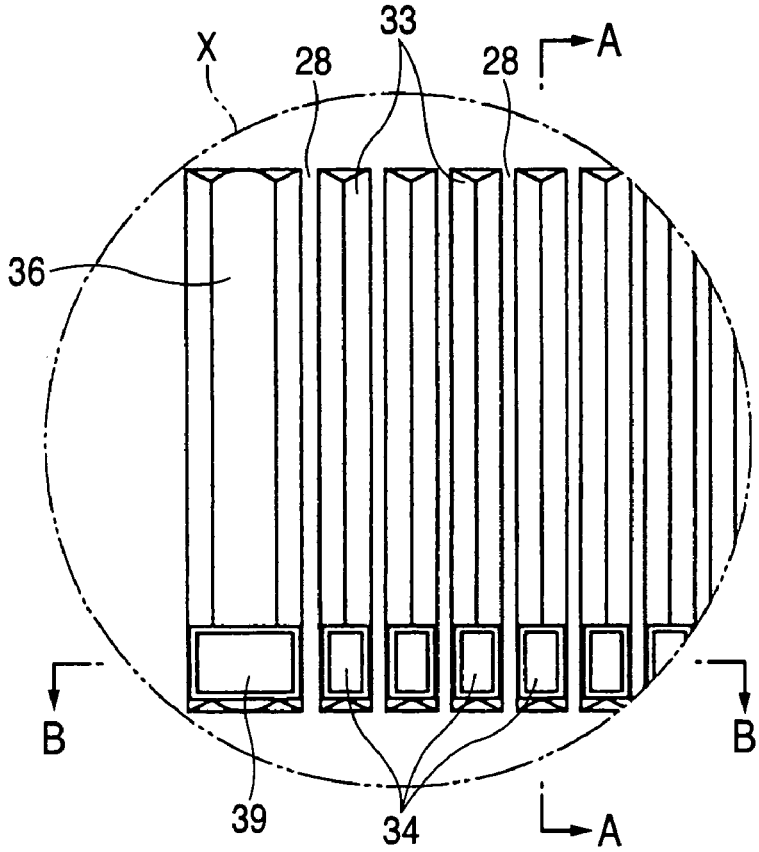
FIG. 5A is a view enlarging an X portion in FIG. 4.
Figure 5B:
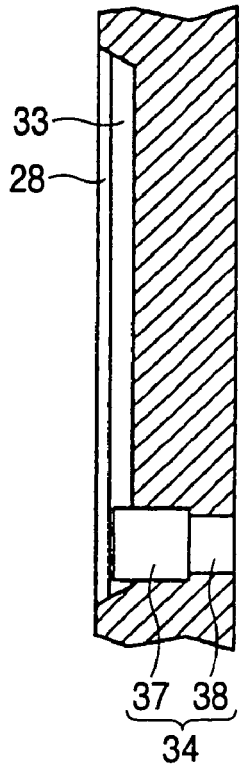
FIG. 5B is a sectional view taken along a line A—A of FIG. 5A.
Figure 5C:
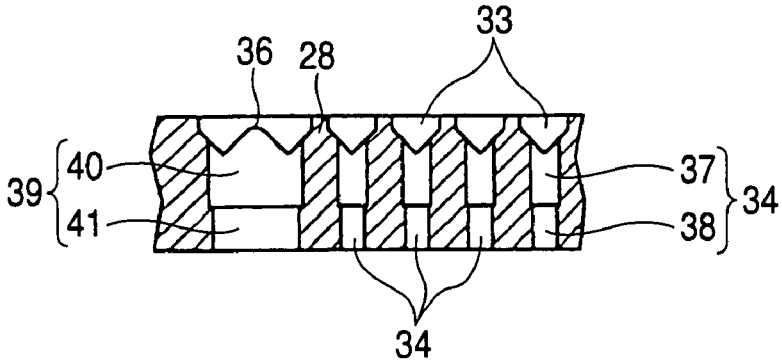
FIG. 5C is a sectional view taken along a line B—B of FIG. 5A.
Figure 6:
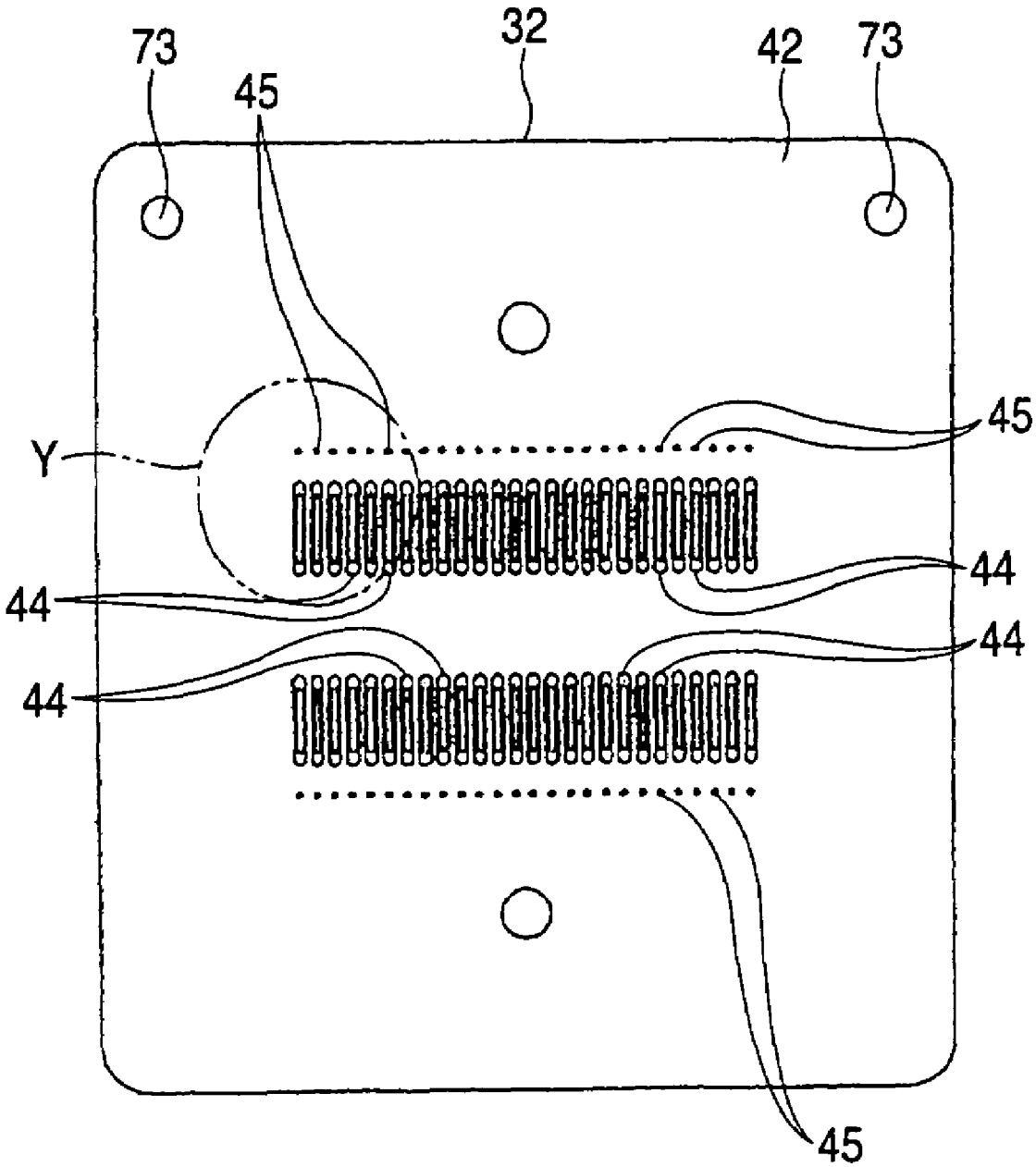
FIG. 6 is a plan view of an elastic plate.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4. That is, there are provided two pairs of the row of the elongated recess portions 33 and the reservoir space 35.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
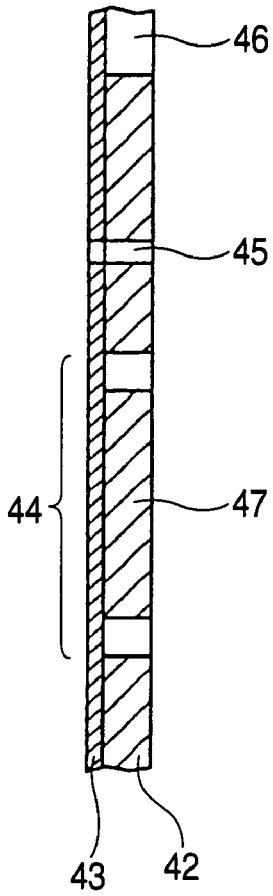
FIG. 7B is a sectional view taken along a line C—C of FIG. 7A.
Figure 7A:
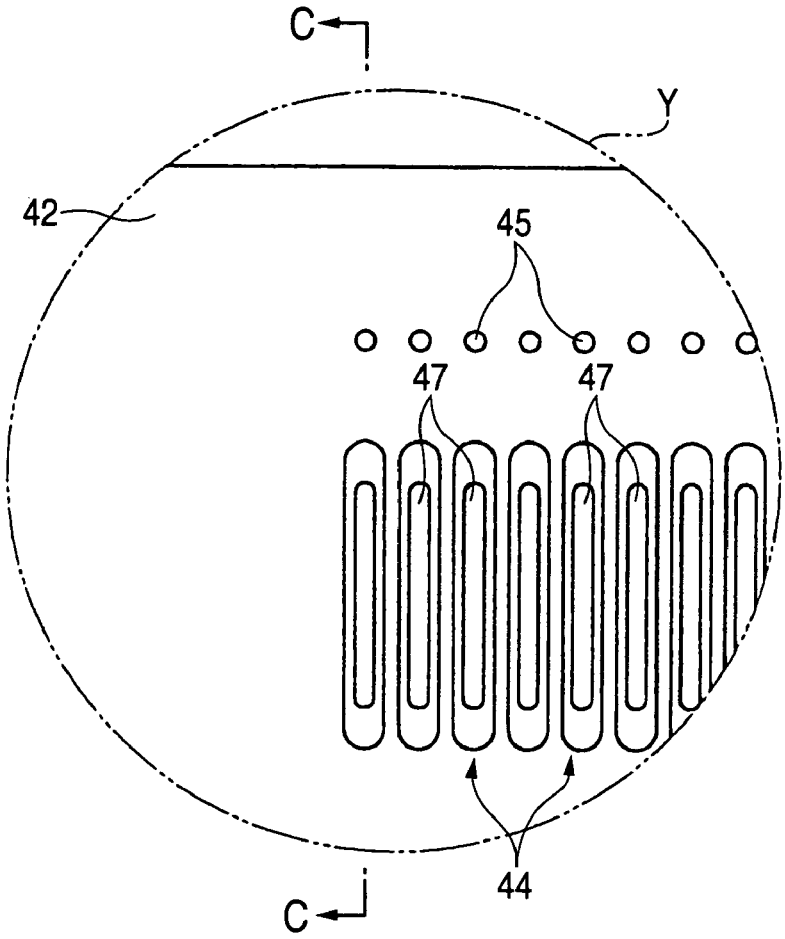
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

Further, the support plate 42 and the elastic film 43 constituting the elastic plate 32 are not limited to the example. Further, polyimide may be used as the elastic film 43.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

Figure 8:
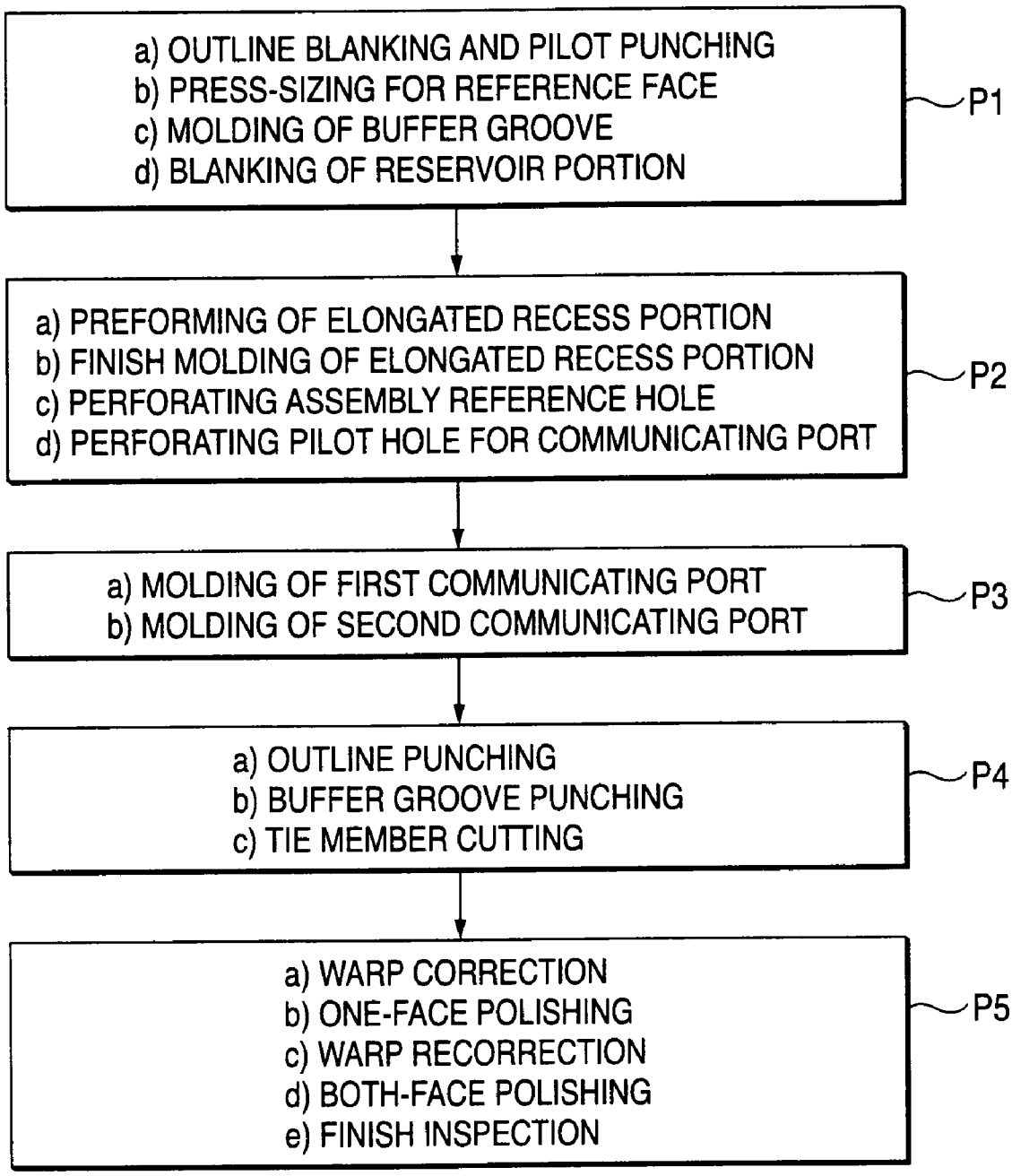
FIG. 8 is a flow chart for explaining each process for fabricating the chamber formation plate.

FIG. 8 is a flow chart for explaining an outline of the whole of a manufacturing process of the chamber formation plate 30.

A nickel strip (metal material) is supplied to a progressive type forging machine having a large number of various dies. A first process P1 in the forging machine comprises: blanking which defines an outer shape of a product or pilot punching; press-sizing of a reference face by which the metal material is supported; molding of a buffer groove for absorbing flow of material (described later); and blanking of a portion to be the common ink reservoir 14.

A second process P2 comprises: preforming of the elongated recess portions 33 to be the pressure generating chambers 29; finish molding of the elongated recess portions; molding of pilot holes necessary to mold communicating ports 34 for leading ink to nozzle orifices 48; and molding of assembly reference holes necessary to join the nozzle plate 31 and the elastic plate 32 to the chamber formation plate 30.

A third process P3 is of molding the communicating ports 34 at an end portion of the molded elongated recess portion 33, and comprises: molding of first communicating ports 37 as bottomed holes; and molding of second communicating ports 38 as through holes by punching the bottomed holes.

A fourth process P4 comprises: blanking before making the material plate into an individual product; blanking of the buffer groove; and making the material plate into a single pressure chamber formation plate 30 by cutting tie members.

A finishing process P5 comprises: warp-correction of the chamber formation plate 30; one-face polishing of the chamber formation plate 30; warp-recorrection; and both-face polishing; and finish inspection.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by performing each step of the forging work described with FIG. 8, with a progressive die. Further, a metal strip 55 (referred to as "strip 55" in the following explanation) used as a material of the chamber formation plate 30 is made of nickel as described above.

Figure 9A:
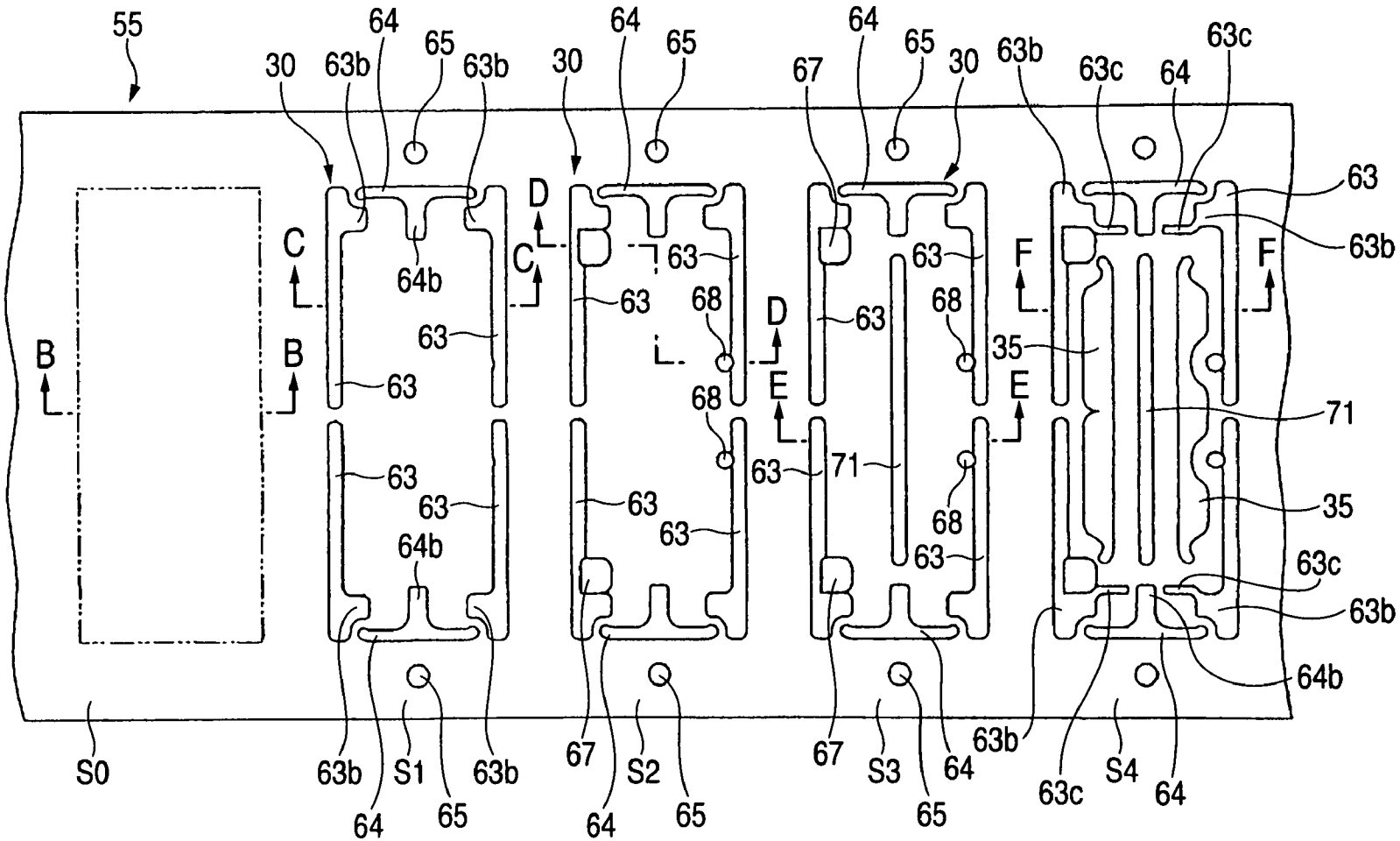
FIG. 9A is a plan view of a material plate subjected to a first process in FIG. 8.
Figure 9B:
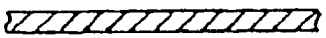
FIG. 9B is a section view taken along a line B—B shown in FIG. 9A.

In a zeroth stage S0 in the first process P1, as shown in FIGS. 9A and 9B, the material 55 is in the non-worked state.

Figure 9C:
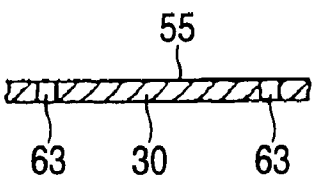
FIG. 9C is a section view taken along a line C—C shown in FIG. 9A.
Figure 9D:
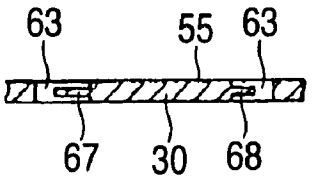
FIG. 9D is a section view taken along a line D—D shown in FIG. 9A.

In a first stage S1, slits defining the outline of the chamber formation plate 30 is blanked, in which four elongated longitudinal slits 63 and two T-shaped lateral slits 64 are blanked (see also FIG. 9C). Simultaneously with blanking of these slits 63 and 64, pilot holes 65 for positioning the material 55 in each work stage is formed. In FIG. 9G, the material 55 is placed on a lower die 66*a*, and the longitudinal slit 63 is blanked by a blanking punch 63*a*. The slits 63 and 64 are thus blanked, and the inside of the slits becomes a region at which the chamber formation plate 30 is worked. An extended part 63*b* of the longitudinal slit 63 and an extended part 64*b* of the lateral slit 64 are opposed to each other.

Figure 13:
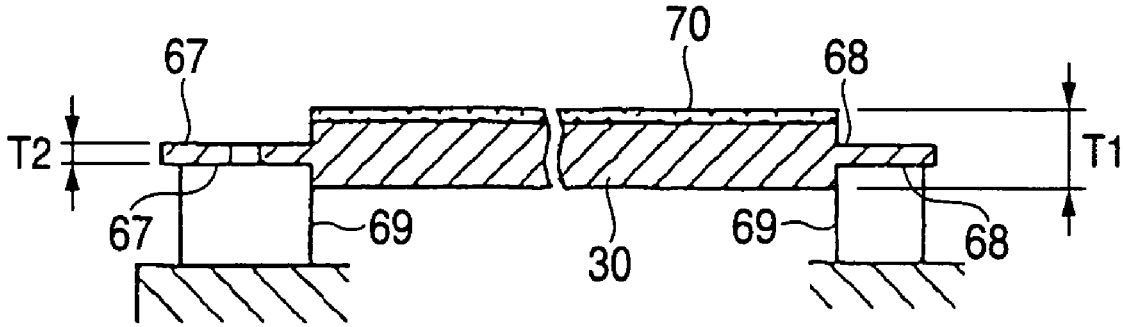
FIG. 13 is a view showing a state that the chamber formation plate is supported while using reference faces.

A second stage S2 is of press-sizing a reference face. Reference faces 67 and 68 (see also FIG. 9D) are supported when an adhesive is applied on the chamber formation plate 30. Namely, as shown in FIG. 13, the region (having the thickness T1) to be the chamber formation plate 30 is partly pressed, so that the thickness of the reference faces 67 and 68 are reduced to T2. The reference faces 67 and 68 of the finished chamber formation plate 30 are placed on a support jig 69, and an adhesive 70 is applied on the chamber formation plate 30. At this time, since there is a difference in level (T1−T2/2) between the surface of the chamber formation plate 30 and the reference face 67, 68, the adhesive 70 is not adhered onto the reference faces 67 and 68. The difference in level (T1−T2/2) shown in FIG. 13 is shown exaggeratingly in order to facilitate understanding. In FIG. 9H, reference numerals 67*a* and 68*a* designate press punches, each of which performs a press operation in association with a lower die 66*b*.

Figure 9E:
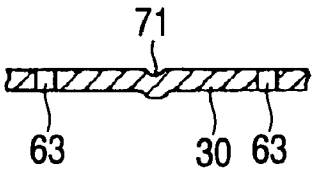
FIG. 9E is a section view taken along a line E—E shown in FIG. 9A.

A third stage S3 is of molding a buffer groove 71 (see also FIG. 9E). The buffer groove 71 prevents, when the elongated recess portion 33 is press-molded, the material from flowing in the longitudinal direction of the elongated recess portion 33 and rising. The flow of the material is absorbed in space of the buffer groove 71. In FIG. 91, a protruding streak 71*a* for molding the buffer groove 71 is provided for a punch, and a groove 71*b* in association with the protruding streak 71*a* is provided for a lower die 66*c*.

Figure 9F:
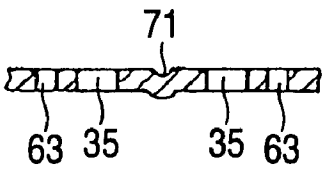
FIG. 9F is a section view taken along a line F—F shown in FIG. 9A.
Figure 9G:
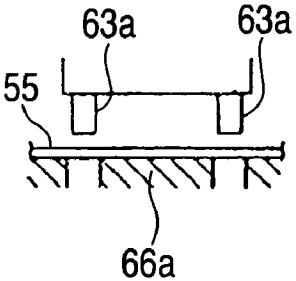
FIG. 9G is a partial section view showing dies used in a first stage shown in FIG. 9A.
Figure 9H:
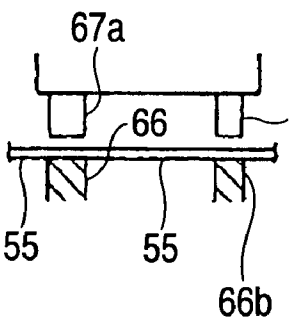
FIG. 9H is a partial section view showing dies used in a second stage shown in FIG. 9A.
Figure 9I:
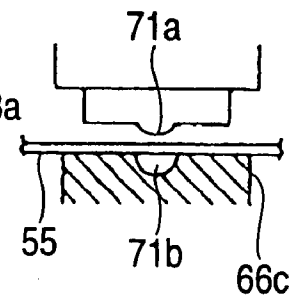
FIG. 9I is a partial section view showing dies used in a third stage shown in FIG. 9A.
Figure 9J:
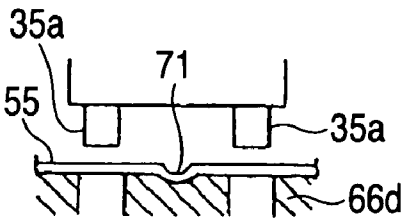
FIG. 9J is a partial section view showing dies used in a fourth stage shown in FIG. 9A.

A fourth stage S4 is of blanking the reservoir portion 35 along the buffer groove 71 in the region of the chamber formation plate 30 (see also FIG. 9F). An elongated portion is arranged between the reservoir portion 35 and the buffer groove 71, and the elongated recess portion 33 is formed in this portion. Reference numeral 35*a* in FIG. 9J designates a blanking punch, which operates in association with a lower die 66*d*. Further, between the extended part 63*b* and the longitudinal slit 64*b*, an extension slit 63*c* extending from the extended part 63*b* toward the longitudinal slit 64*b* is formed. The extension slit 63*c* is blanked simultaneously with the reservoir portion 35. The extension slit 63*c* is thus blanked in the stage S4, whereby it can be prevented that the shape of the blanking punch 63*a* for the longitudinal slit 63 becomes complicated and durability of the punch lowers.

Figure 10A:
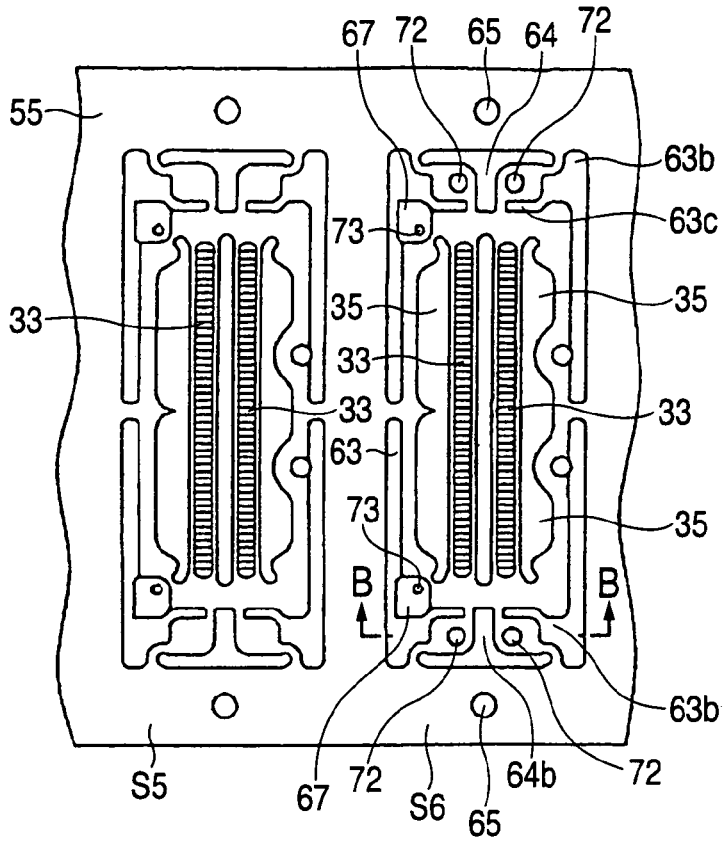
FIG. 10A is a plan view of the material plate subjected to a second process in FIG. 8.
Figure 10B:
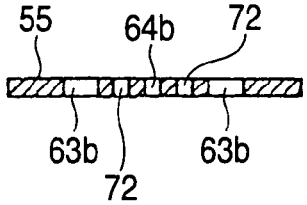
FIG. 10B is a section view taken along a line B—B shown in FIG. 10A.

In the second process P2, as shown in FIGS. 10A and 10B, molding of the elongated recess portions 33, perforating of the pilot holes for working the communicating ports 34, and perforating of the assembly reference holes are performed.

Figures 10C, 10D, 10E, 10F:
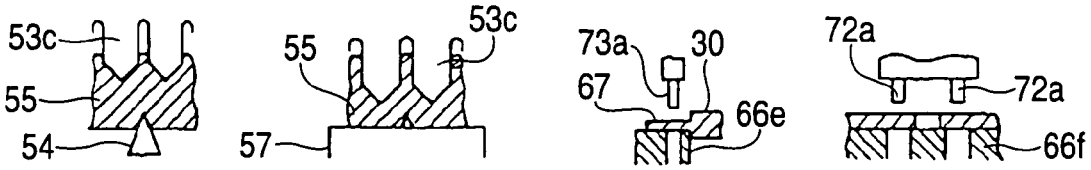
FIG. 10C is a partial section view showing dies used in a fifth stage shown in FIG. 10A.
FIG. 10D is a partial section view showing first dies used in a sixth stage shown in FIG. 10A.
FIG. 10E is a partial section view showing second dies used in the sixth stage shown in FIG. 10A.
FIG. 10F is a partial section view showing third dies used in the sixth stage shown in FIG. 10A.

A fifth stage S5, as shown in FIG. 10C, is of preforming of the elongated recess portions 33, in which projections 53*c* and a projection 54, which will be described later, are pressed against the strip 55, and the elongated recess portion 33 is preformed.

A sixth stage S6, as shown in FIG. 10D, of finishing the elongated recess portion 33, in which the strip 55 is further pressed between the projections 53*c* and a finishing die 57 described later. The projections 53*c* are pushed into the strip up to the required depth of the elongated recess portion 33, and stops in the maximum stroke position thereby to finish the elongated recess portion 33 with the predetermined dimension.

In the sixth stage S6, in a state where the projections 53*c* are stopping in the maximum stroke position, assembly reference holes 73 are formed in the reference faces 67, and pilot holes 72 for working the communicating ports 34 are perforated. As shown in FIG. 10E, a perforating punch 73*a* for perforating the assembly reference hole 73 operates in association with a lower die 66*e*. Further, as shown in FIG. 10F, four pilot holes 72 are formed, and a perforating punch 72*a* for the pilot hole 72 operates in association with a lower die 66*f*.

Further, when the projection 53*c* pushed in the maximum stroke position is withdrawn, a space of the elongated recess portion 33 deforms elastically (so-called spring back), and its displacement causes position errors of the assembly reference hole 73 and pilot hole 72. However, the above elastic displacement is absorbed by the reservoir portion 35, the extension slit 63*c*, the extended part 63*b* and the lateral slit 64, whereby position errors of the holes 72, 73 and the pilot hole 65 are prevented. Further, since the assembly reference hole 73 and the pilot hole 72 are perforated in a state where the projection 53*c* is held at the maximum stroke position, positional accuracy of the assembly reference hole 73 and pilot hole 72 in relation to the elongated recess portion 33 can be secured.

Figure 14A:
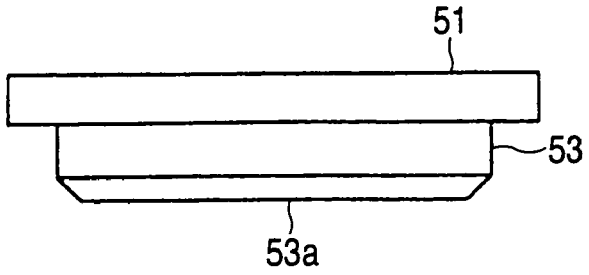
FIGS. 14A and 14B are views for explaining a male die used in forming an elongated recess portion.
Figure 14B:
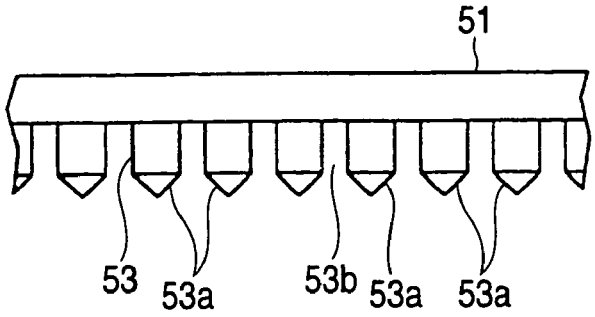
Figure 15A:
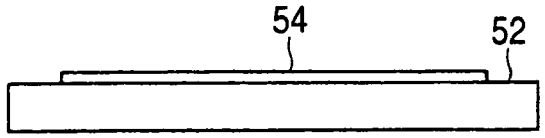
FIGS. 15A and 15B are views for explaining a female die used in forming the elongated recess portion.
Figure 15B:
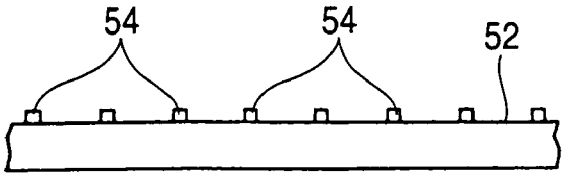

In the elongated recess portion forming steps, a male die 51 shown in FIGS. 14A and 14B and a female die shown in FIGS. 15A and 15B are used. The male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 14B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 14A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 16A:
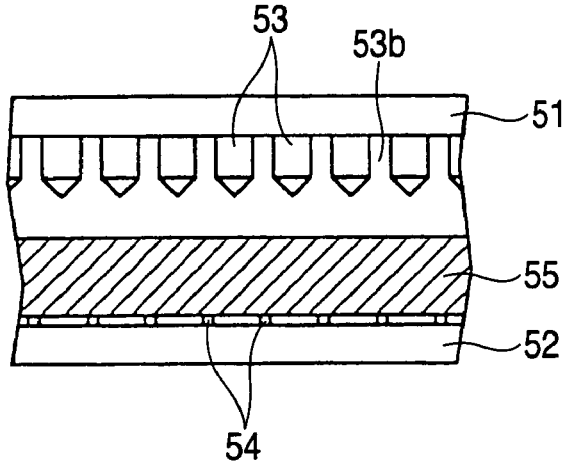
FIGS. 16A to 16C are views for explaining a step of forming the elongated recess portion.
Figure 16B:
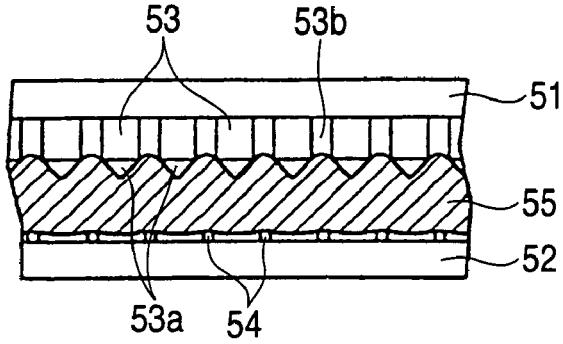
Figure 16C:
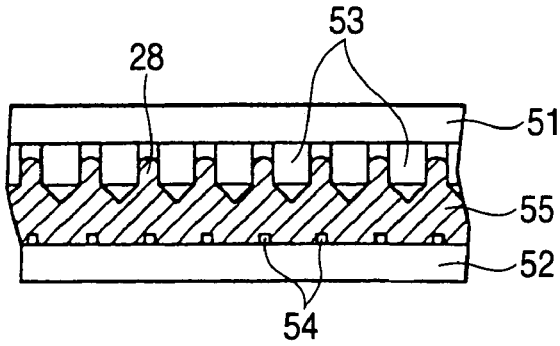

In the elongated recess portion forming steps, first, as shown in FIG. 16A, the strip 55 is mounted at an upper face of the female die 52 and the male die 51 is arranged on an upper side of the strip 55. Next, as shown in FIG. 16B, the male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a middle in a plate thickness direction of the strip 55 as shown in FIG. 16C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

Figure 11A:
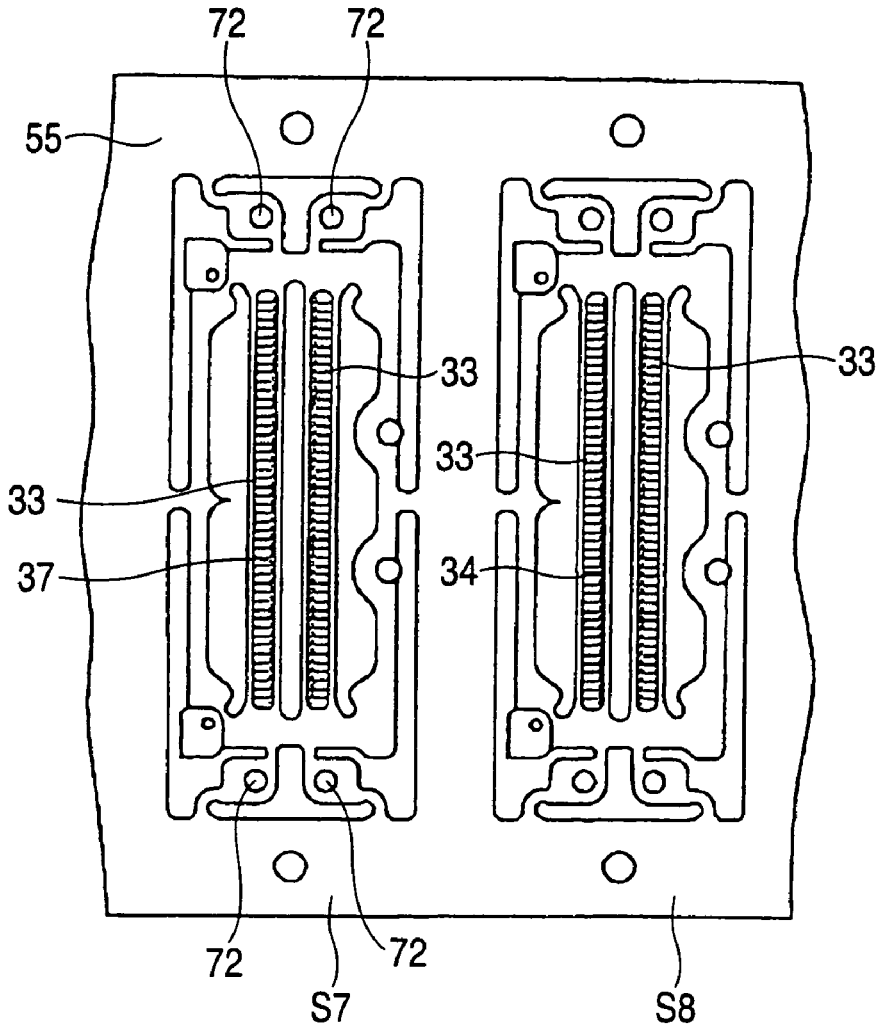
FIG. 11A is a plan view of the material plate subjected to a third process in FIG. 8.

In the third process P3, as shown in FIG. 11A, the communicating ports 34 are formed by molding the first communicating ports 37 and the second communicating ports 38.

Figure 11B:
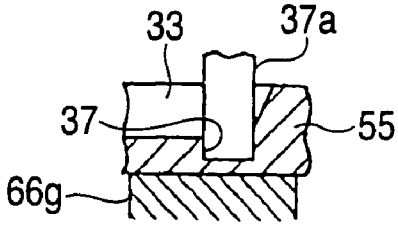
FIG. 11B is a partial section view showing dies used in a seventh stage shown in FIG. 11A.

A seventh stage S7 is of press-molding a bottomed first communicating port 37 at an end portion of each elongated recess portion 33. As shown in FIG. 11B, a perforating punch 37*a* operates in association with a lower die 66*g*.

Figure 11C:
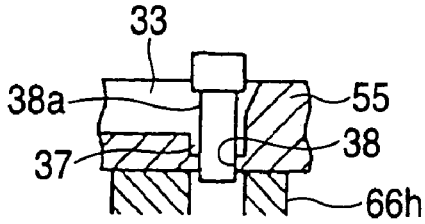
FIG. 11C is a partial section view showing dies used in an eighth stage shown in FIG. 11A.

An eighth stage S8 is of forming the second communicating port 38 in the bottom of the first communicating port 37. The second communicating port 38 passes through the strip 55, whereby the communicating port 34 is completed. As shown in FIG. 11C, a perforating punch 38*a* operates in association with a lower die 66*h*.

Reference pins (not shown) provided on the lower die 66*g* (66*h*) passes through the above pilot holes 72, whereby registration error of the strip 55 is prevented. Therefore, the communicating port 34 is exactly molded at the end portion of each minute elongated recess portion 33.

The above stages S7 and S8 may be performed by progressive work. However, in a case where the perforating punches 37*a* and 38 are fine and frequency of punch damage is high, the stages S7 and S8 can be performed by individual work.

Figure 12A:
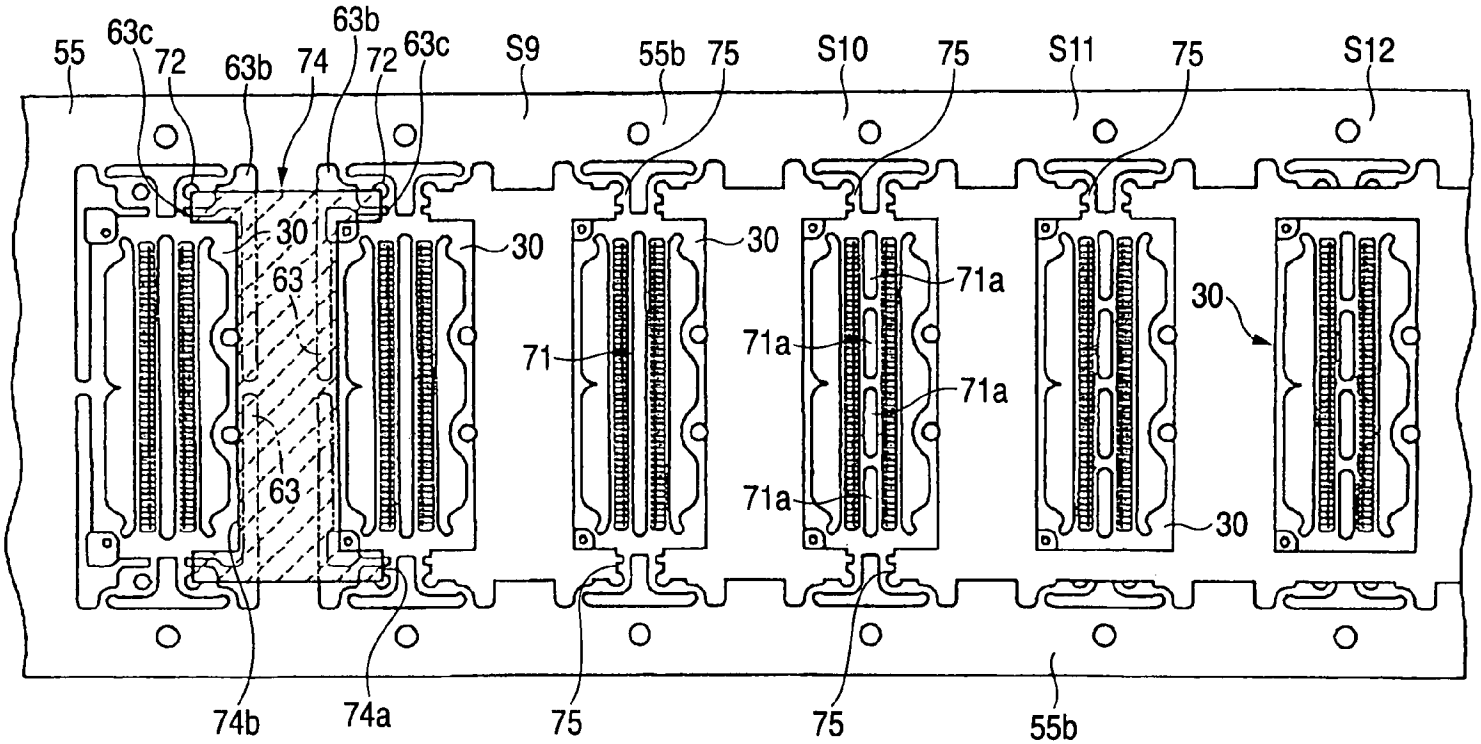
FIG. 12A is a plan view of the material plate subjected to a fourth process in FIG. 8.

The fourth step comprises, as shown in FIG. 12A, blanking of the longitudinal slit 63, blank-perforating of the buffer groove 71, and cutting of tie members 75.

Figure 12B:
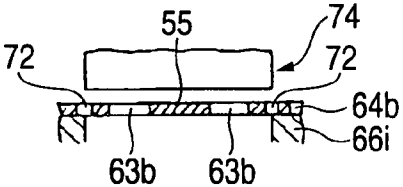
FIG. 12B is a partial section view showing dies used in a ninth stage shown in FIG. 12A.

A ninth stage S9 is a preparation stage for making the chamber formation plate 30 into a single article by blanking the longitudinal slit 63. As shown in FIG. 12B, a blanking die 74 is struck between the adjacent chamber formation plates 30. The actual blanking operation is performed in a position designated by a reference character S9. However, in order to understand the positional relation between the blanking die 74 and the longitudinal slit 63, the hatched blanking die 74 is shown on the left side of the actual position.

The blanking die 74 comprises a wide portion 74*a* having the span between the pilot holes 72 of the adjacent chamber formation plates 30, and a narrow portion 74*b* having the span between the adjacent longitudinal slits 63. The blanking die 74 operates in association with a lower die 66*i*.

Figure 12C:
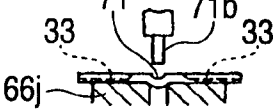
FIG. 12C is a partial section view showing dies used in a tenth stage shown in FIG. 12A.
Figure 12D:
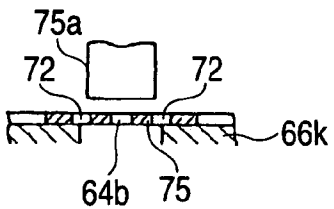
FIG. 12D is a partial section view showing dies used in an eleventh stage shown in FIG. 12A.
Figure 12E:
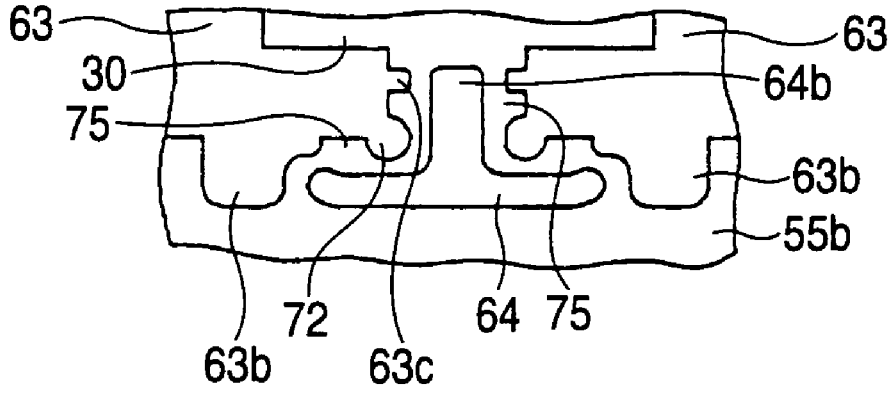
FIG. 12E is an enlarged plan view showing tie members.

As blanking is performed in order by the blanking die 74 in the stage S9, the tie members 75 connecting the chamber formation plate 30 portion and the right and left portions 55*b* in the advance direction of the strip 55 is formed. FIG. 12E is a plan view in which a part of the portion blanked by the blanking die 74 is enlarged.

A tenth stage S10 is of blanking the buffer grooves 71 in four positions and forming four slit holes 71*a*. As shown in FIG. 12C, a perforating punch 71*b* for blanking the slit hole 71*a* operates in association with a lower die 66*j*. By providing these slit holes 71*a*, the region protruding to the back side of the strip 55 is narrowed, whereby a polishing time can be reduced. Further, since it is can be prevented that the bonding area becomes large unnecessarily, the extra amount of the adhesive 70 is reduced, so that it is possible to prevent the adhesive 70 from entering the elongated recess portion 33. Further, the slit hole 71*a* located at the end portion may be communicated with atmosphere, whereby the buffer groove 71 can be communicate with the atmosphere, so that drying of the adhesive can be promoted and a respiratory phenomenon due to change of temperature can be performed.

An eleventh stage S11 is of blanking one of the two tie members 75. As shown in FIG. 12D, a blanking die 75*a* operates in association with a lower die 66*k*. When the tie member 75 is blanked, the connecting state between the left and right portions 55*b* of the strip 55 and the pressure generating forming plate 30 is cut off as shown in the downside of S11.

A twelfth stage S12 is of blanking the other of the tie members 75 similarly to in the eleventh stage S11. By this blanking, the chamber formation plate 30 is cut off from the strip 55 and becomes a single article.

After the above fourth step, the finishing process P5 is performed.

Figure 17:
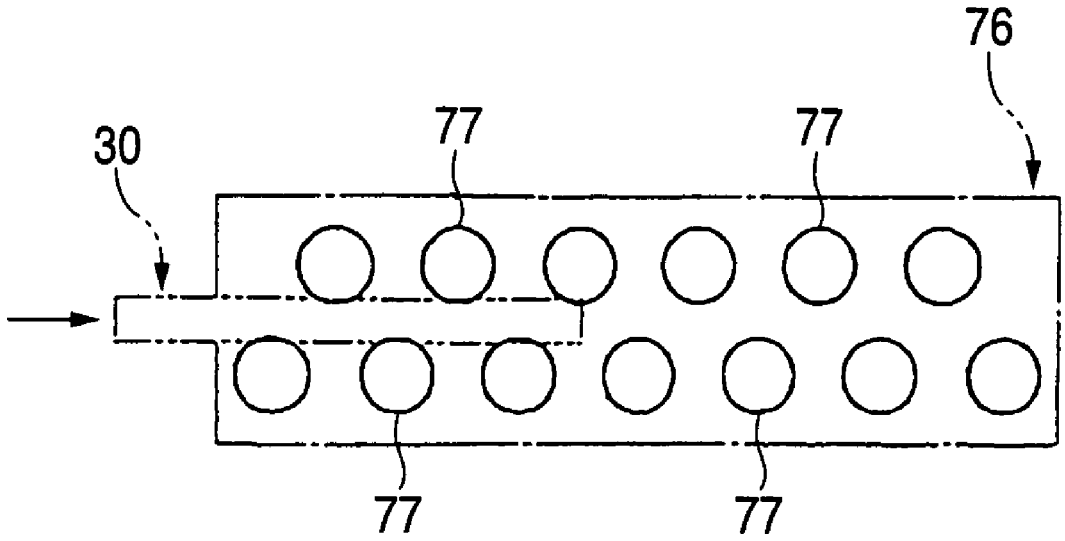
FIGS. 17 and 18 are diagrams for explaining a warp correction work.

In the chamber formation plate 30 immediately after being cut off from the strip 55, various residual stress exist. Therefore, the plate 30 is not completely flat and has small warp or curve. In order to correct this state, warp correction is performed. Though various methods can be adopted as this warp correction method, in this example, a roller type correction apparatus 76 is adopted as shown in FIG. 17. Many correction rollers 77 arranged in arrays on one imaginary plane are set at the predetermined distance, and the chamber formation plate 30 is caused to pass between these arrays to perform the warp correction. After the chamber formation plate 30 is caused to pass firstly in the longitudinal direction, the plate 30 is turned at 90 degrees and the warp correction is performed again. Namely, in the X and Y directions, the correction rollers 77 are applied to the chamber formation plate 30 thereby to perform the correction of higher accuracy.

Figure 18:
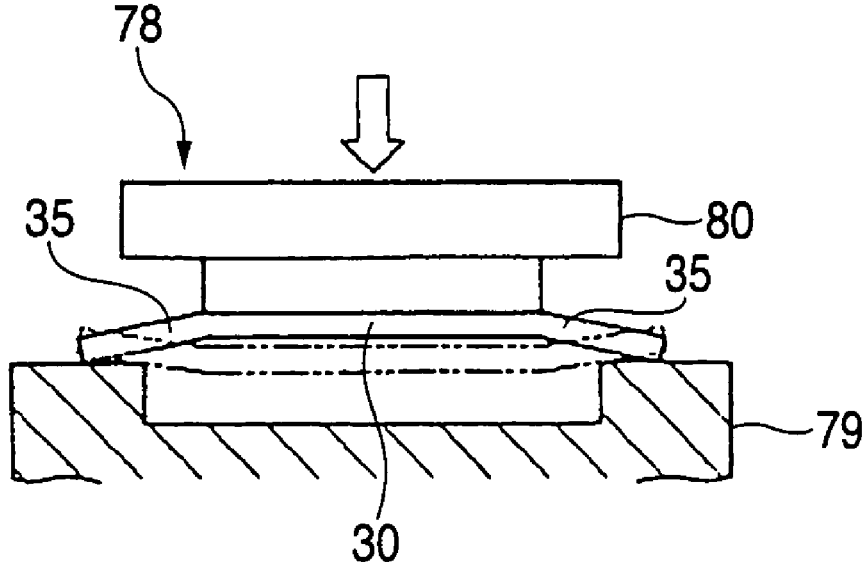

In place of the above roller type correction apparatus 76, a hand press type correction apparatus 78 shown in FIG. 18 can be used. The reservoir portions 35 arranged on the left and right sides of the chamber formation plate 30, as shown in FIG. 18, are bent and deformed by the stress in molding of the elongated recess portions 33. Therefore, the chamber formation plate 30 placed on a lower die 79 is pressed by an upper die 80 to perform correction of the bending portions.

Figure 19:
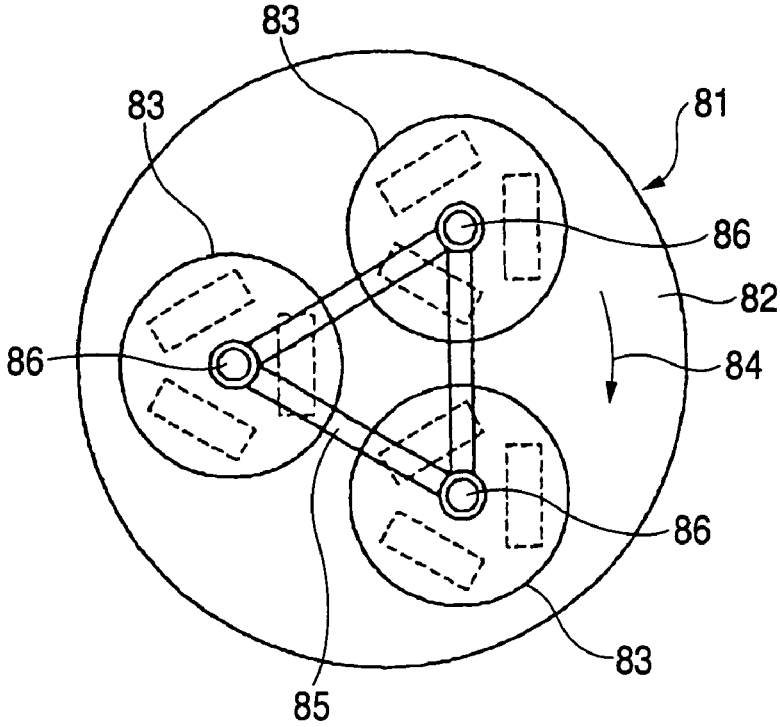
FIG. 19 is a plan view showing an apparatus for performing a one-face polishing work.

After the warp correction is completed, one surface of the chamber formation plate 30 is polished by a polishing apparatus shown in FIG. 19. Though various types of polishing apparatus can be adopted, a rotary plate type polishing apparatus 81 is adopted here. Namely, rotary holding discs 83 cooperating with an abrasive flat plate 82 are provided, the chamber formation plate 30 is held by the holding disc 83, and this holding disc 83 is revolved (refer to an arrow 84) while being rotated on its own center. The chamber formation plate 30 is thus polished by the abrasive plate 82. Reference numeral 85 is a link mechanism for revolving the holding discs 83 in the coupling state, and it gives rotary power to a shaft 86 of each holding disc 83 thereby to rotate the holding disc 83 on its own center.

In the one-side polishing, the thickness of the chamber formation plate 30 changes, so that the warp and curve are produced. Therefore, the warp correction is performed again by the similar method to the methods shown in FIGS. 17 and 18.

Figure 20:
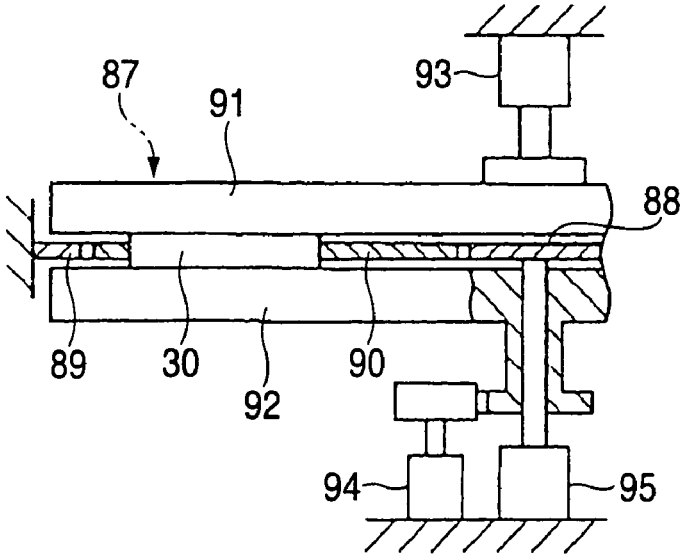
FIG. 20 is a partial section view showing an apparatus for performing a both-face polishing work.

When the warp re-correction is completed, both-side polishing is performed. FIG. 20 is a sectional view showing a both-side polishing apparatus 87. Between a sun gear 88 located in the center and an internal gear 89 located at the periphery, a planetary gear disc 90 is interlocked. The chamber formation plate 30 is placed between abrasive plates 91 and 92 opposed to each other while being fittingly held by the planetary gear disc 90. The abrasive plates 91 and 92 are rotated by electric motors 93 and 94, and the sun gear 88 is rotated by an electric motor 95.

When the both-side polishing is completed, the operation proceeds to a finish inspection stage.

In the stage S5 of the second process P2 described above, the preforming of the elongated recess portions 33 by a preforming die 56, and the state where the elongated recess portions 33 are molded by a finishing die 57 will be described in detail with reference to FIGS. 21 through 23D.

Plastic working is performed on the strip (material) 55 by the male die 51 and the female die 52 under condition of room temperature, and plastic working described below is performed similarly under condition of room temperature.

Figure 21:
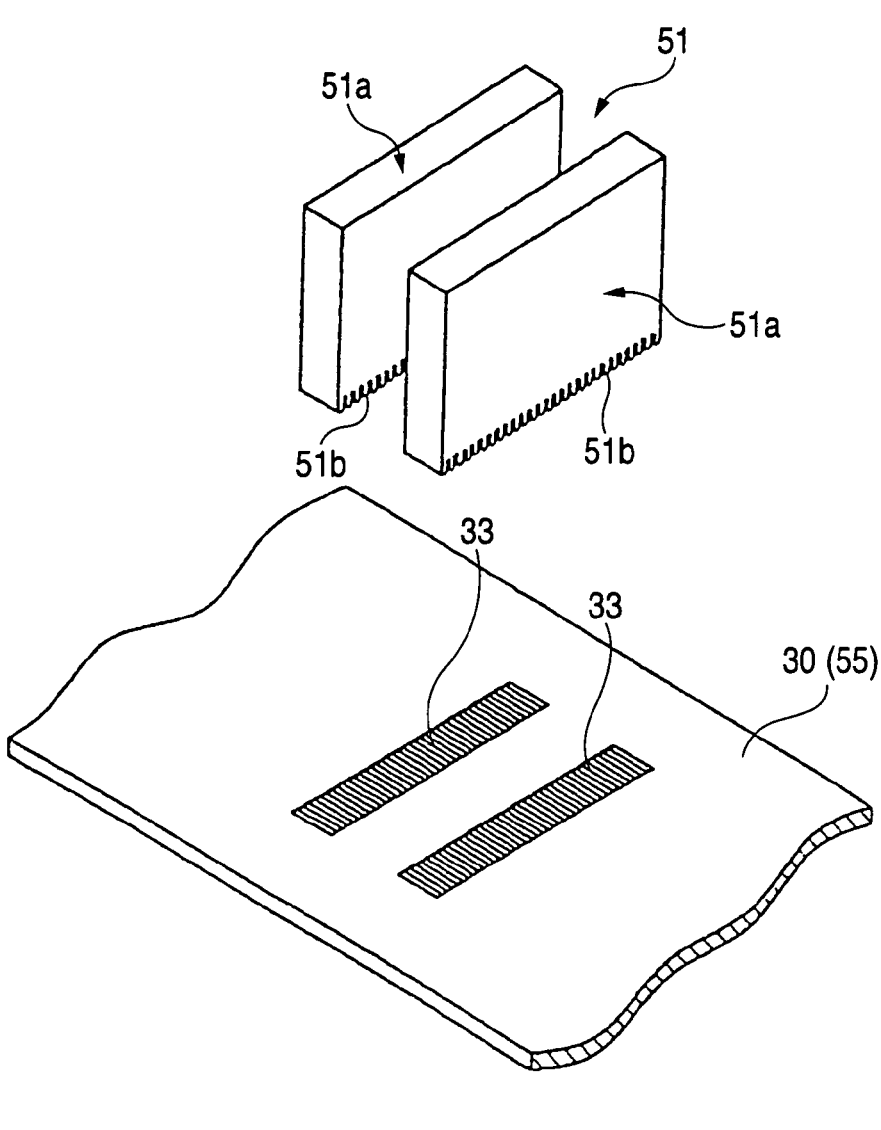
FIG. 21 is a perspective view showing a relationship between the male die and a material to be processed.

As shown in FIG. 21, large number of molding punches 51*b* are arranged in the male die 51*a*, that is, the first die. In order to form the elongated recess portions 33, the molding punches 51*b* are elongated to form projections 53*c*. The projections 53*c* are arranged in parallel at a predetermined pitch. In order to form the partition walls 28, gaps 53*b* (see FIG. 22B) are provided between the molding punches 51*b*. A state in which the first die 51*a* is pushed into the chamber formation plate 30 (strip 55) to be a worked object is shown in FIG. 22C.

In this embodiment, the material (strip) 55 is caused to flow into the gaps 53*b* by the preforming die 56 and the distribution of the material 55 in the gaps 53*b* is caused to approach a normal state as much as possible by the finishing die 57. Consequently, the amount of the flow of the material into the gaps 53*b* is brought into an almost straight state in the longitudinal direction of the gaps 53*b*, which is convenient for the case in which that portions are caused to serve as a member such as the partition wall 28 of the pressure generating chambers 29 of the liquid ejection head 1.

The structure and operation of the second die 52*a* will be described in detail as follows.

Figure 22A:
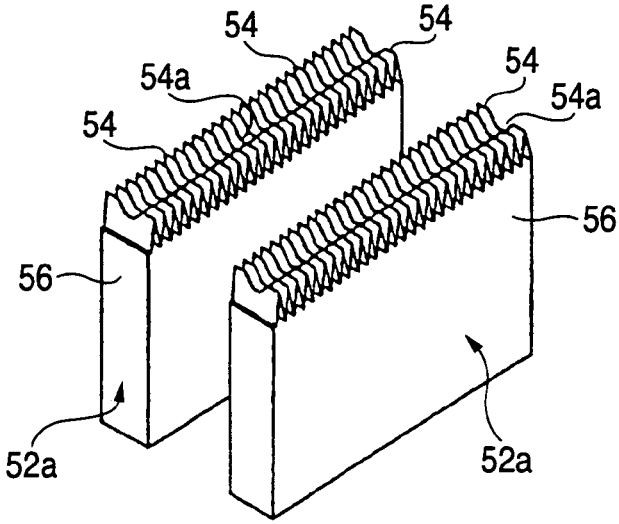
FIG. 22A is a perspective view of a preforming female die according to one embodiment of the invention.

As shown in FIG. 22A, in a female die 52*a*, that is, the second die, each of projections 54 is formed with a concave portion 54*a* at a portion corresponding to the longitudinal middle part of the projection 53*c*. The preforming die 56 is provided with the projections 54 opposed to the gaps 53*b* and having almost the same length as the length of the gaps 53*b*.

Figure 22B:
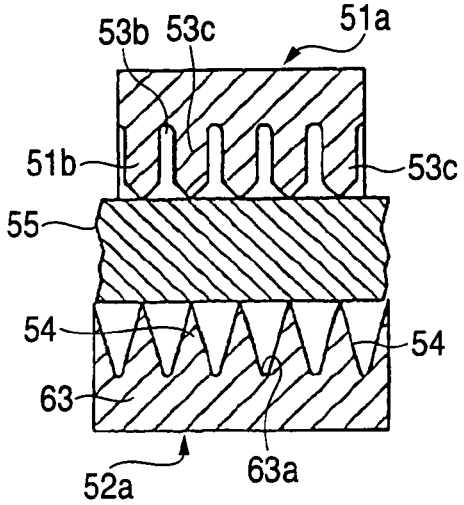
FIGS. 22B and 22C are sectional views showing a primary molding.
Figure 22C:
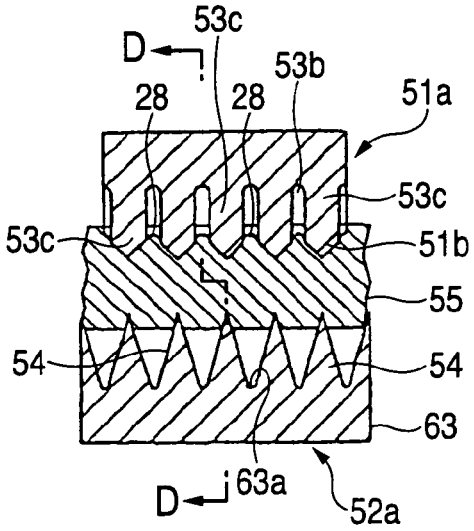

The projection 54 conceptually shown in FIGS. 15A through 16C is a convex member having a small height. In order to form the concave portion 54*a*, a certain height is actually required for the projection 54. In order to obtain such a certain height, each of the projections 54 has a wedge-shaped cross section as shown in FIG. 22B. The angle of the wedge-shaped portion is set to be an angle of 90 degrees or less. Valley portions 56*a* are defined between the adjacent projections 54.

The length of the concave portion 54*a* of the projection 54 in the longitudinal direction is set to be approximately ⅔ of the length of the projection 54 or less. Preferably, it is ½ of the length of the projection 54 or less. The pitch of the projection 54 is set to be 0.14 mm. The pitch of the projection 54 is set to be 0.3 mm or less so that more suitable preforming is carried out in a forging work of a component such as the liquid ejection head. The pitch is preferably 0.2 mm or less and more preferably 0.15 mm or less. Furthermore, at least the concave portion 54*a* of the projection 54 has a surface thereof finished smoothly. For the finishing, mirror finishing is suitable, and furthermore, chromium plating may be carried out.

Figure 23A:
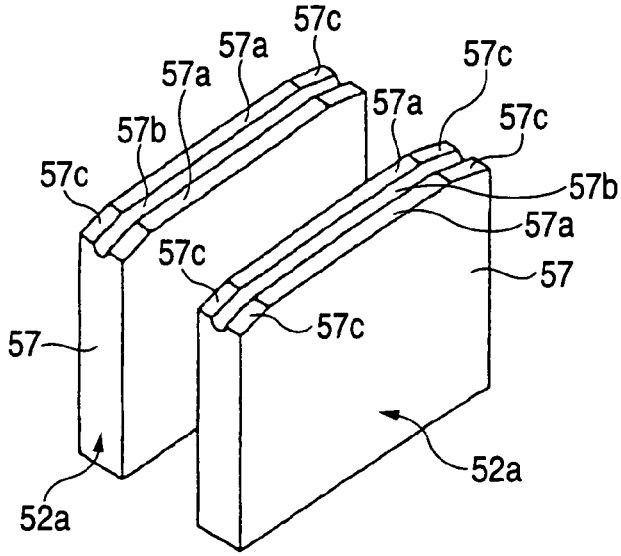
FIG. 23A is a perspective view of a finishing female die according to one embodiment of the invention.

The finishing die 57 is used after the primary molding using the preforming die 56. As shown in FIG. 23A, the finishing die 57 is formed with flat surfaces 57*a* located both sides of a concave portion 57*b*. The flat surfaces 57*a* and the concave portion 57*b* are extended entirely in the longitudinal direction of the finishing die 57. The concave portion 57*b* is located at a part corresponding to the concave portions 54*a* of the projections 54 in the preforming die 56.

Slope faces 57*c* are provided both longitudinal ends of each flat surface 57*a* such that portions closer to the ends are lowered.

Next, description will be given to the operation of the forging punch constituted by the first die 51*a* and the second die 52*a*.

Figure 22D:
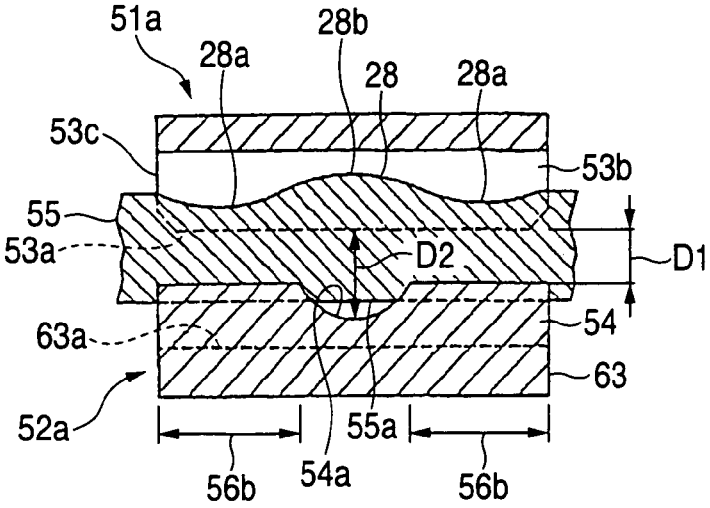
FIG. 22D is a sectional view taken along a line D—D in FIG. 12C.

FIG. 22B shows a state obtained immediately before the material (strip) 55 is pressurized between the first die 51*a* and the second die 52*a*. When the projections 54 are pressed into the material 55 as shown in FIGS. 22C and 22D, the material is caused to flow into the gaps 53*b* so that the partition wall 28 is preformed.

Incidentally, the second die 52*a* is provided with the concave portion 54*a* having a small height in a middle part. In portions 56*b* close to the ends of the second die 52*a* on both sides of the concave portion 54*a* (see FIG. 22D), an interval D1 between both of the dies 51*a* and 52*a* is smaller than an interval D2 between the middle parts thereof where the concave portion 54*a* is formed. In this narrow portion, the amount of the pressurization of the material is increased so that the material thus pressurized is caused to flow to be pushed out in a direction which is almost orthogonal to the direction of the pressurization. That is, the material is moved toward the concave portion 54*a* in which the amount of the pressurization is smaller. In other words, the concave portion 54*a* serves to provide a place into which the material 55 escapes. Such a material movement is mainly carried out in the longitudinal direction of the projections 53*c* or the gaps 53*b*, so that a part of the material 55 becomes a bulged portion 55*a* which is protruded into the concave portion 54*a*.

Furthermore, a much larger amount of the material 55 is positively pushed into the gaps 53*b* by the contribution of the sufficient height of the projections 54. In the partition wall 28 set in such a preforming state, lower portions 28*a* and a higher portion 28*b* are formed as shown in FIG. 22D. Such a difference in the height is made because a larger amount of the material 55 pressurized in the end portions 56*b* flows to the concave portion 54*a* while a large amount of the material 55 flows into the gaps 53*b* simultaneously.

Moreover, since the projections 53*c* are arranged at a predetermined pitch, the plastic flow of the material in the transverse direction of the projections 53*c* caused by the press-fitting operation is smoothly made uniform for both the direction of the flow and the amount of the flow.

Since the material 55 flowing into the gaps 53*b* as configured the above constitutes the partition wall 28 of the elongated recess portions 33, the shape of the elongated recess portion 33 can be formed accurately. For forming such a minute structure, an anisotropic etching method is generally employed. Since such a method requires a large processing man-hour, it is disadvantageous in respect of the manufacturing cost. On the other hand, if the forging punch is used for a metallic material such as nickel, the processing man-hour is considerably reduced. Furthermore, since the processing can be carried out with a uniform volume of each elongated recess portion 33, in a case where the pressure generating chamber of the liquid ejection head is to be formed, the ejection performance of the liquid ejection head is stabilized.

Since the concave portion 54*a* takes the shape of an arcuate concave portion, the height of the middle part of the second die is gradually changed. Consequently, the amount of the material 55 flowing into the gaps 53*b* becomes as uniform as possible in the longitudinal direction of the gaps 53*b*. In a case where the concave portion 54*a* is formed with a plurality of flat faces, it is possible to obtain the same effect by selecting the inclination angle of the sloped flat faces.

In a case where the convex portion 54*b* is provided in the middle part of the concave portion 54*b*, a plurality of concave portions 54*a* are defined so that portions in which the amount of the pressurization is large and portions in which the amount of the pressurization is small are alternately provided. Accordingly, the portions (corresponding to 56*b*) in which the amount of the pressurization is large and the concave portion 54*a* to which the material 55 is flown are alternately provided with small pitches. Consequently, the amount of the material 55 flowing to the gaps 53*b* is almost uniform in the longitudinal direction of the gaps 53*b*.

By selecting a length of the concave portion 54*a* in the longitudinal direction of the projections 54 to be about ⅔ as large as a length of the projection 54, an amount of material flowing in a direction substantially orthogonal to the pressing direction is satisfactorily balanced with the size of the concave portion 54*a* for receiving the material in view of a magnitude of a pressing stroke. Accordingly, the material flow into the gaps 53*b* is optimized.

Since at least the concave portion 54*a* of the projection 54 has a surface thereof finished smoothly by mirror finishing or chromium plating, the flow direction of the material 55 is positively changed toward the gaps 53*b* so that the flow of the material into the gaps 53*b* can be carried out more positively.

Figure 23B:
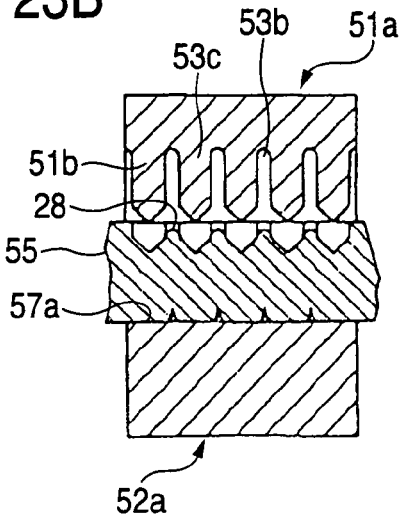
FIGS. 23B and 23C are sectional views showing a secondary molding.
Figure 23C:
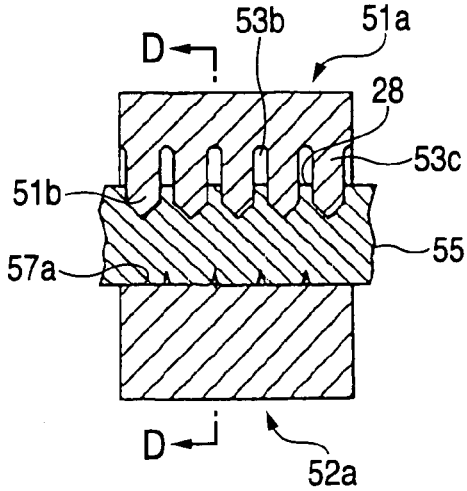
Figure 23D:
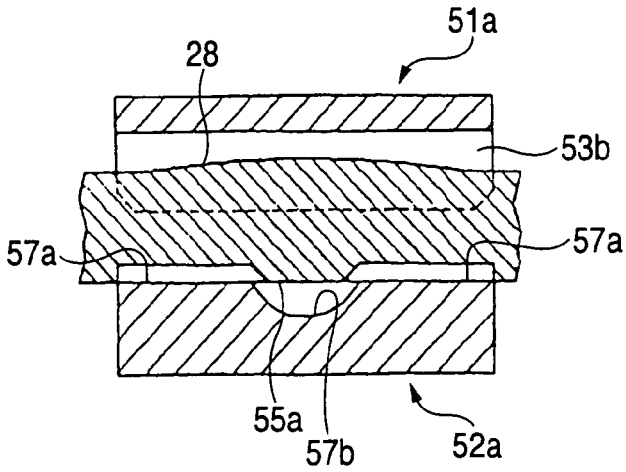
FIG. 23D is a sectional view taken along a line D—D in FIG. 13C.

When the primary molding shown in FIGS. 22C and 22D is completed, the material 55 is moved between the first die 51*a* and the finishing die 57 as shown in FIG. 23B, and is pressurized therein by both of the dies 51*a* and 52*a* as shown in FIG. 23C. The flat surfaces 57*a* increases the amount of the material 55 flowing into the gaps 53*b* so that the heights of the lower portions 28*a* are increased. Incidentally, since the bulged portion 55*a* is accommodated in the concave portion 57*b* and does not receive pressurizing force from the finishing die 57, the height of the higher portion 28*b* is rarely changed. Accordingly, the height of the partition wall 28 finally becomes almost uniform as shown in FIG. 23D.

In the finishing forming stage, since the slope faces 57*c* are formed, the amount of the material 55 flowing into each gaps 53*b* is caused to be as uniform as possible in all the gaps 53*b*. Namely, the material 55 flows in the arrangement direction of the projections 53 little by little from the central part of the array of the projections 53 toward the both ends thereof so that the vicinity of the ends of the material are made thick due to the accumulation of the plastic flow. Since the thick portions are pressurized by the slope faces 57*c* which are lowered, the material in the thick portions can be prevented from excessively flowing into the gaps 53*b*. Accordingly, the amount of the flow of the material 55 can be as uniform as possible in all the gaps 53*b*.

Since the projection 54 takes the shape of a wedge having a sharp tip (the wedge angle is 90 degrees or less), the wedge-shaped portion reliably cuts into the material 55 so that the material 55 in the portions opposed to the gaps 53*b* can be accurately pressurized and the flow of the material into the gaps 53*b* can be carried out reliably. Further, since the pitch of the projections 54 is set to be 0.3 mm or less, the pressure generating chamber of the liquid ejection head can be precisely fabricated by the forging punch.

The first die 51*a* and the second die 52*a* are fixed to an ordinary forging device (not shown), and the chamber formation plate 30 (the strip 55) is provided between both of the dies 51*a* and 52*a* so that the forging work is progressively carried out. Moreover, the second die 52*a* is constituted by the preforming die 56 and the finishing die 57 in pairs. Therefore, it is preferable that the preforming die 56 and the finishing die 57 are arranged adjacently to each other so that the chamber formation plate 30 (the strip 55) is sequentially moved.

In the stage S6 of the second process P2 described above, the perforating of the pilot holes 72 and the assembly reference holes 73 will be described in detail with reference to FIGS. 24 through 27B.

Figure 24:
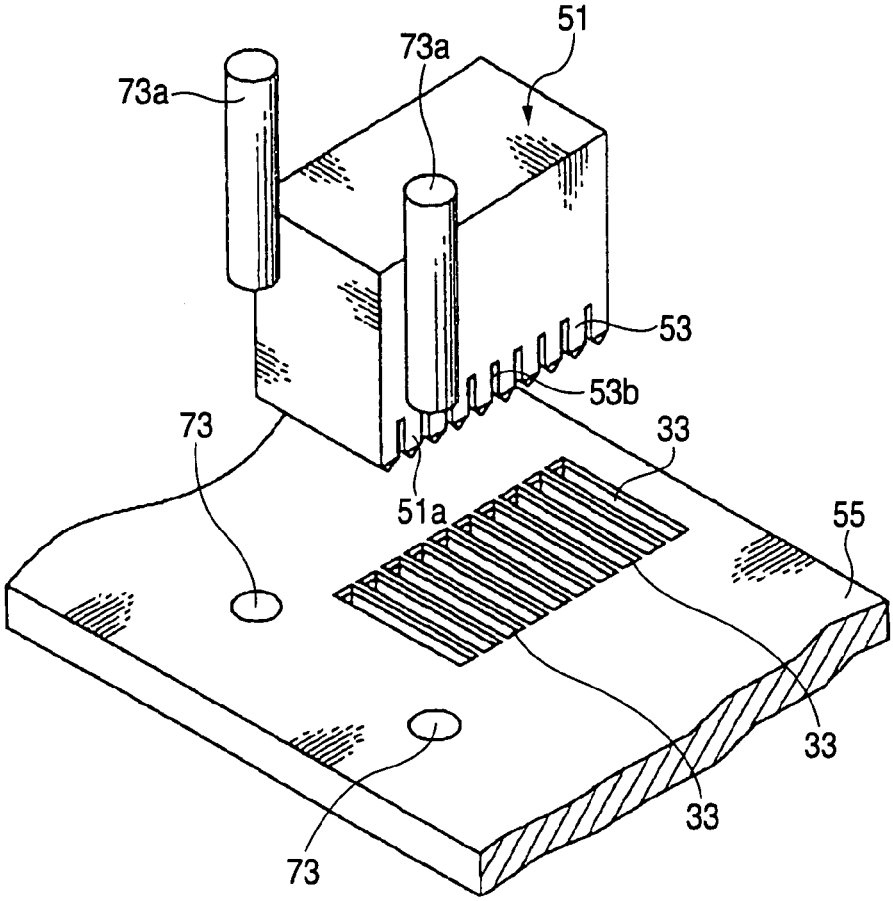
FIG. 24 is a perspective view for explaining a work for perforating assembly reference holes.
Figure 25:
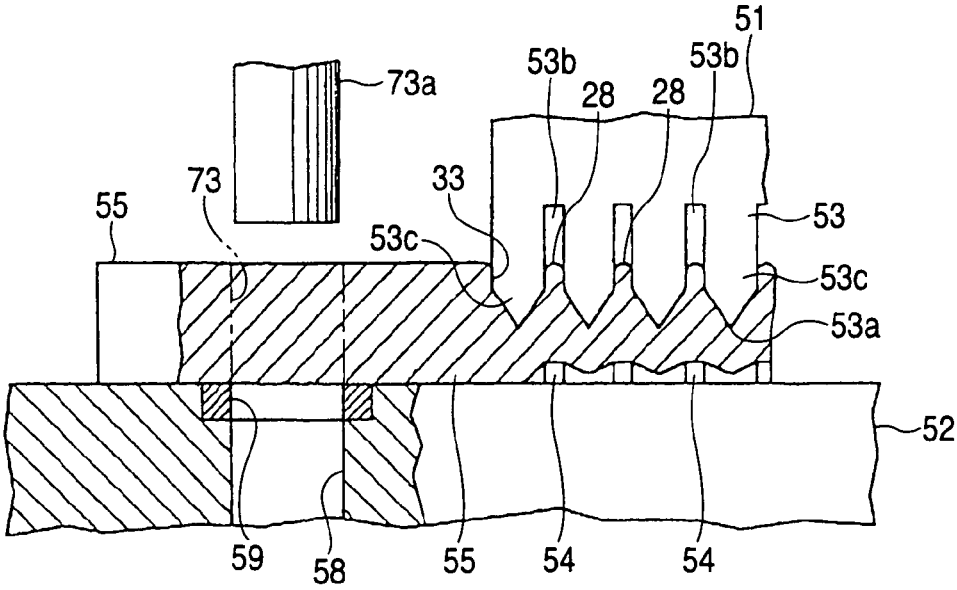
FIG. 25 is a partial section view for explaining the work for perforating the assembly reference holes.

As show in FIGS. 24 and 25, the perforating punches 73*a* for forming the reference holes 73 are arranged in positions in the vicinity of the male die 51. FIG. 25 shows a state that the male die 51 is pressed into the strip 55 to be the chamber formation plate 30. An opening 58 is provided in the female die 52 (corresponding to the dies 66*e* in FIG. 10E) so as to oppose to the perforating punch 73*a*. A die 59 is arranged at the opening end of this opening 58. The perforating punch 73*a* advances and presses the strip 55 against the die 59, so that the reference hole 73*s* are formed by shearing and blanking as shown in FIG. 24.

A forging machine used here is a general type, and operates plural dies simultaneously or in order (for example, double action). The male die 51 is coupled to a first drive unit (not shown) of the forging machine, and the perforating punch 73*a* is coupled to a second drive unit (not shown) of the same forging machine.

Figure 26:
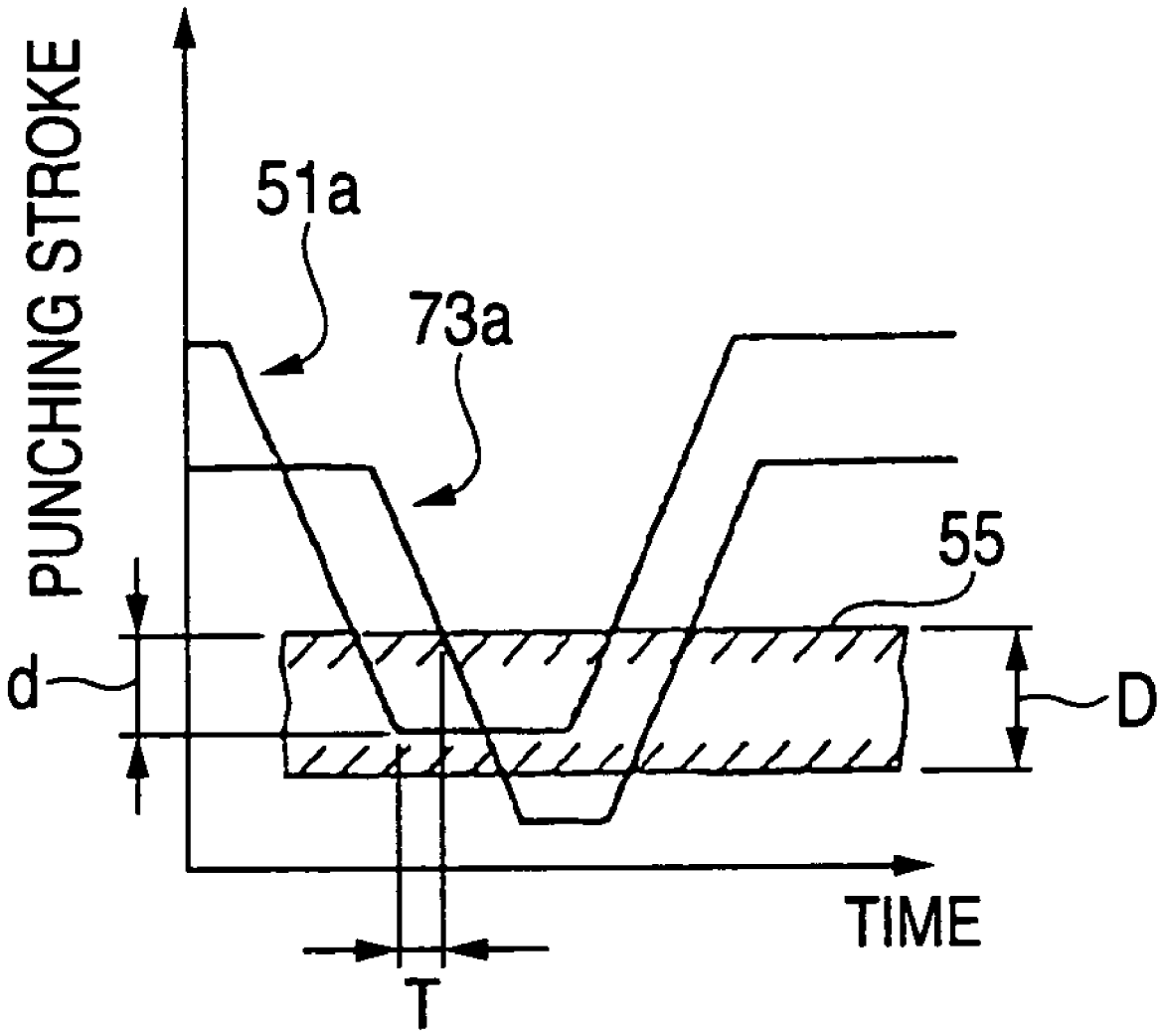
FIG. 26 is an operational diagram of a punch for molding the elongated recess portions and a punch for perforating the assembly reference holes.

FIG. 26 is an operational diagram showing a timing of the molding operations of the male die 51 and the perforating punch 73*a*. The molding punch 51*a* precedes and pushes the strip 55 thereby to form the elongated recess portions 33 having a depth d. In a state where the molding punch 51*a* stops in a maximum stroke position where it finishes molding the elongated recess portions 33, the punch 73*a* advances to form the reference holes 73. Namely, after the predetermined time T passed since the molding punch 51*a* has been pushed into the strip 55, the shearing and blanking operation by the punch 73*a* is started. Since the reference hole 73 is formed by blanking, the stroke of the punch 73*a* exceeds the thickness D of the strip 55. Herein, the delay time T is 0.5 seconds. By setting the delay time, a flow of the material in the worked portion of the elongated recess portion 33 and action of stress are eliminated, and working condition of the reference hole 73 is settled.

Here, the male die 51 stopping in the maximum stroke position is being pushed into the position where the elongated recess portions 33 have been molded. In this state, the flow of the metal material is completed, and the stress with the flow is also completely eliminated. After the influence on the vicinity of the circumference produced in molding of the elongated recess portions 33 is eliminated, the perforating punch 73*a* is operated to perform the perforating work. Therefore, on the way of the working and in completion of the working, the assembly reference hole 73 is molded without receiving any external force. Accordingly, the reference holes 73 and the elongated recess portions 33 are held in the desired positional relationship, and the plural kinds of worked portions having high accuracy can be obtained.

On the other hand, when the perforating punch 73*a* performs the perforating work, the male die 51 remains entering into the strip 55. Therefore, even in a case where the flow of the metal material produced in the perforating work and the stress with the flow are given to the elongated recess portion 33, the above die 51 serves as a base member such as a core bar, so that it is possible to prevent such a harmful influence as to deform the elongated recess portions 33.

Further, although the flowing amount of the metal material 55 and the stress with its flow become large in such a perforating work, since the molding state of the elongated recess portion 33 is stable, they do not give a bad influence to the worked portion of the elongated recess portion 33.

The elongated recess portions 33 worked before the perforating work is relatively high in minuteness, while the assembly reference hole 73 is relatively lower in minuteness. Therefore, the elongated recess portions 33, which are difficult to enhance the molding accuracy, are first worked and thereafter the assembly reference hole 73 is molded. Since the working state of the worked portion having the high minuteness is determined in the maximum stroke position of the male die 51 and then the perforating work with the low minuteness is carried out, molding quality of the worked portion having the high minuteness can be secured at the desired level.

Since the plural kinds of worked portions such as the elongated recess portions 33 and the assembly reference holes 73 are worked in the same working stage, the relative position of each worked portion is exactly obtained. Namely, since plural kinds of dies mounted on the forging machine are simultaneously or sequentially pressed on the static metal material 55, the metal material 55 does not move while each worked portion is molded, so that the positional relation among the respective worked portions can be exactly set. Further, the number of working steps can be reduced, which is advantageous in manufacturing cost.

In view of the above, there can be finally obtained the chamber formation plate 30 in which the elongated recess portions 33 and the assembly reference holes 73 are formed with high accuracy.

The elongated recess portions 33 are molded by plural working stages including at least the preforming and the finish molding, and the reference hole 73 is perforated in the last stage of the plural working stages. Therefore, the reference hole 73 can be formed under the condition where the flow of the metal material 55 and the influence of the stress with the flow are reduced. Therefore, the external force applied to the molded portion of the reference hole 73 is reduced as much as possible, and the normal formation of the reference hole 73 is realized. Further, since the elongated recess portion 33 is molded by the plural working stages, deformation and flow of the material 55 in the molded part are not continuously occurred. Therefore, the large inner stress does not remain in the material, which is advantageous in molding of the reference hole 73.

Figure 27A:
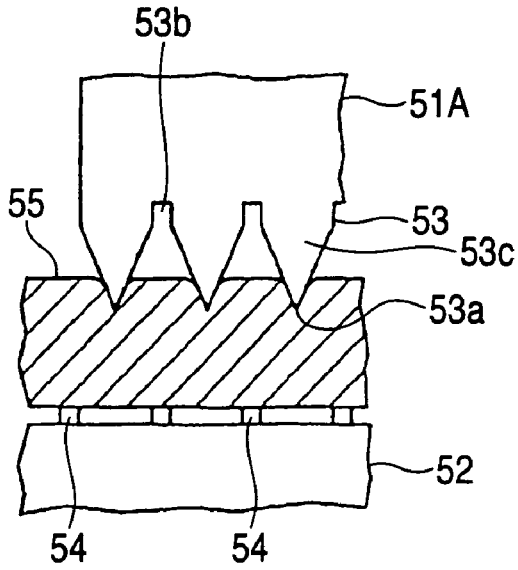
FIGS. 27A and 27B are views showing a modified example of the male die.
Figure 27B:
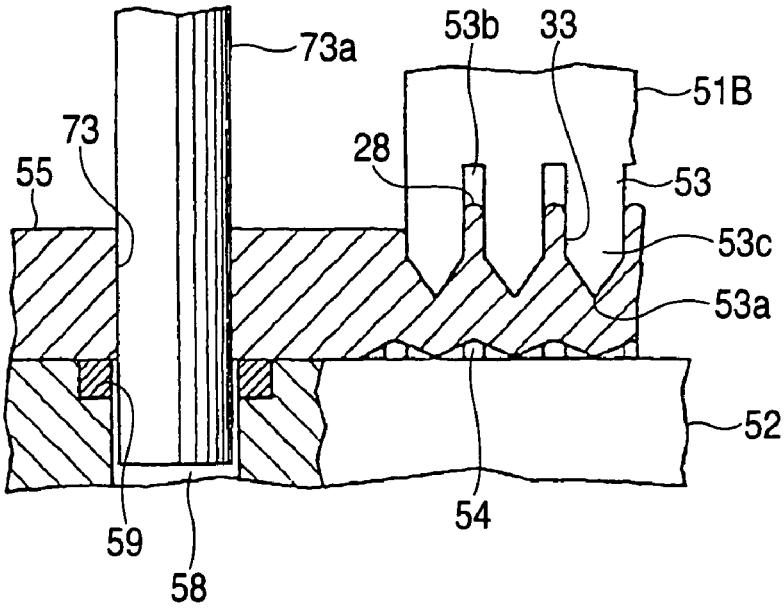

FIGS. 27A and 27B show a case where individual male dies are used to perform the preforming and the finish molding. FIG. 27A shows a preforming male die 51A in which a distal end 53*a* of the projection 53 is made relatively sharp, and the depth of the gap 53*b* is made relatively small.

FIG. 27B shows a finishing male die 51B in which a distal end 53*a* of the projection 53 is made relatively dull, and the depth of the gap 53*b* is made relatively large. In this finish molding, the projections 53 are deeply pressed into the strip 55 so that the partition walls 28 having enough height are molded in the gap 53*b*. The perforating work using the punch 73*a* is performed at this stage as shown. In this case, although the projections 54 are provided on the female die 52, the finishing female die 57 in which a top face is made flat (see FIG. 23A) may be used.

As shown in FIG. 24, two reference holes 73 are formed in the chamber formation plate 30. When the chamber formation plate 30 is assembled as the flow path unit 4, usually it is laminated with the nozzle plate 31 and the elastic plate 32 and assembled on a table jig. The reference holes 73 are fitted with positioning pins erected from the table jig, and the flow path unit 4 is assembled by bonding. The chamber formation plate 30 having the two reference holes 73 through which the two positioning pins pass does not shift in any direction, and the exact assembly is performed.

The elongated recess portions 33 are arranged at a predetermined pitch. Since the relative position between the elongated recess portions 33 and the reference holes 73 is set exactly as described above, when the plural elongated recess portions 33 are assembled to the elastic plate 32, the reference holes 73 assist to exactly adjust the relative position between the elongated recess portion 33 and the ink supply port 45, so that good accuracy in assembly operation is obtained.

A pitch dimension of the elongated recess portions 33 is 0.14 mm. When the pressure generating chamber 29 of the ink jet recording head, which is a precise minute member, is forged, very elaborate forging work is possible. Though the pitch dimension of the elongated recess portions 33 is 0.14 mm in the shown embodiment, by setting this pitch 0.3 mm or less, the parts work of the liquid ejection head is finished more suitably. This pitch is preferably 0.2 mm or less, and more preferably 0.15 mm or less.

As a working method for such minute structure, an anisotropic etching method is generally adopted. However, since this method requires a large number of working steps, it is disadvantage in manufacturing cost. On the contrary, in a case where the above forging work method is used in the material such as nickel, the number of working steps is reduced greatly, which is very advantageous in cost.

More specifically, in a case where the chamber formation plate 30 is formed of nickel, coefficients of linear expansion of the chamber formation plate 30, the elastic plate 32, and the nozzle plate 31 which constitute a flow path unit 4 become nearly uniform. Therefore, when these members are heat-bonded, each member expands uniformly. For this reason, it is difficult to produce mechanical stress such as warp due to difference in ratio of expansion. Consequently, even in a case where the bonding temperature is set at a high temperature, each member can be bonded without hindrance. Further, even in a case where the piezoelectric vibrator generates heat during operation of the recording head and the flow path unit 4 is heated by this heat, each member constituting the flow path unit 4 expands uniformly. Therefore, even in a case where heating produced during operation of the recording head and cooling produced by stop of the operation are performed repeatedly, it becomes difficult to produce disadvantage such as separation in each member constituting the flow path unit 4.

As indicated by dashed lines in FIG. 25, the elongated recess portion 33 and the reference hole 73 are worked as closely to each other as possible, whereby the displacement amount of the position of the reference hole 73 due to temperature change can be minimized, and accuracy in assembly can be more enhanced. Namely, since the amount of the metal material 55 between the elongated recess portion 33 and the reference hole 73 becomes small, the change amount of the relative position between the elongated recess portion 33 and the reference hole 73 due to the temperature change is reduced up to a level that does not matter. Accordingly, the elongated recess portion 33 communicates with the ink supply port 45 in the elastic plate 32 properly, so that quality of exact assembly is obtained.

Also in connection with the pilot holes 72, similarly to the case of the assembly reference holes 73, the perforating work is performed in the state where the male die 51 descends up to the maximum stroke, and its working is performed in the same working stage as the elongated recess portions 33. Hereby, the pilot holes 72 can also secure the positional relation having high accuracy for the elongated recess portions 33, so that the perforating work for the communicating ports 34 in the next third process P3 can be performed at high accuracy.

In view of the above, the invention can be applied to a case where there are a plurality kinds of members to be worked in the same stage as the molding of the elongated recess portions 33. Accordingly, regarding each of the worked portions having the different function from each other, working can be performed with the positional relation having high accuracy for the minute worked portion.

In the above embodiment, the projections 54 provided on the female die 52 are opposed to the gaps 53*b* defined between the projections 53 provided on the male die 51. However, as shown FIGS. 28A and 28B, the projections 53 and the projections 54 may be opposed to each other. As well as FIGS. 27A and 27B, the preforming male die 51A and the finishing male die 51B are shown. In this case, since the material located between the protruding portion 53 and the projection 54 receives the largest compressive force, whereby a large amount of material flows to the gaps 53*b* located on the both sides of the projection 54, so that a partition wall 28 having enough height can be molded.

Figure 28A:
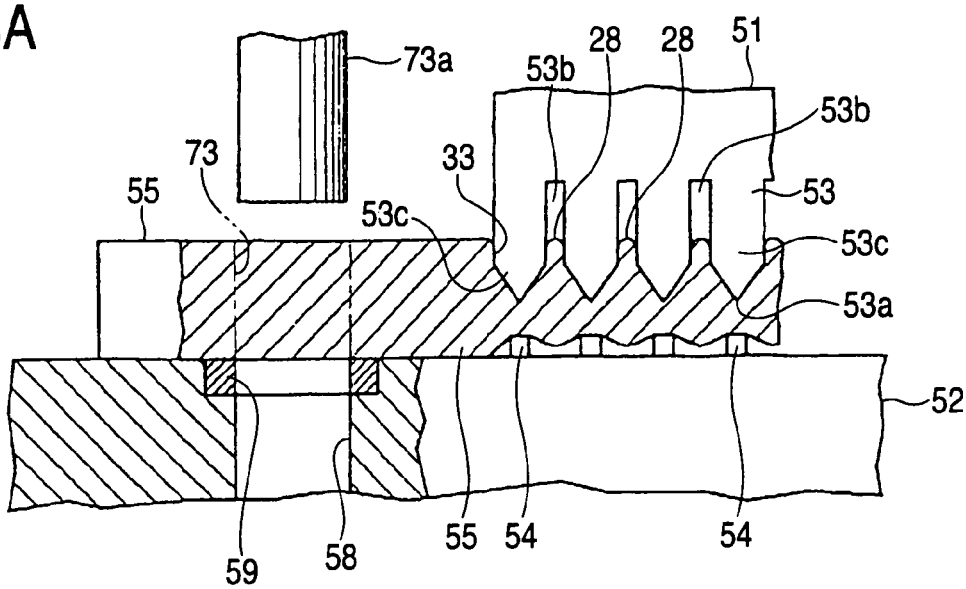
FIGS. 28A and 28B are views showing a first modified example of the female die.
Figure 28B:
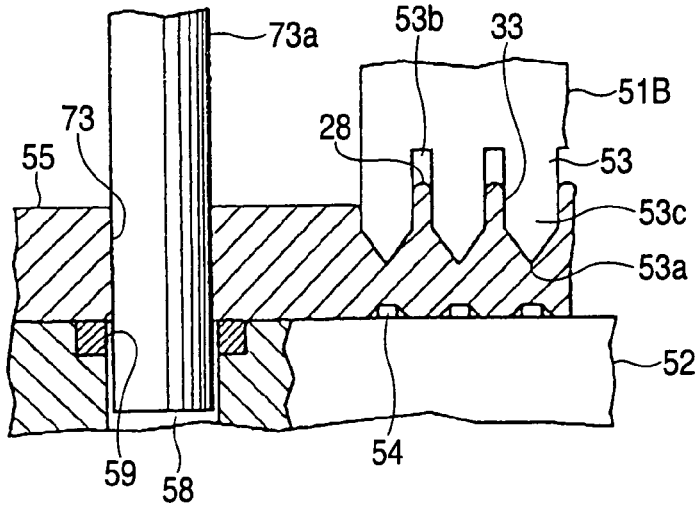
Figure 28C:
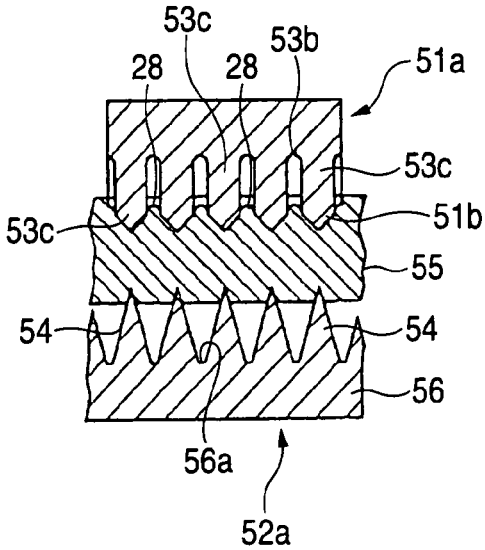
FIG. 28C is a view showing a second modified example of the female die.

FIG. 28C shows a case where the projection 54 is pointed in the shape of a wedge, in which a phenomenon of plastic flow is the same as that in FIGS. 28A and 28B.

Figure 29:
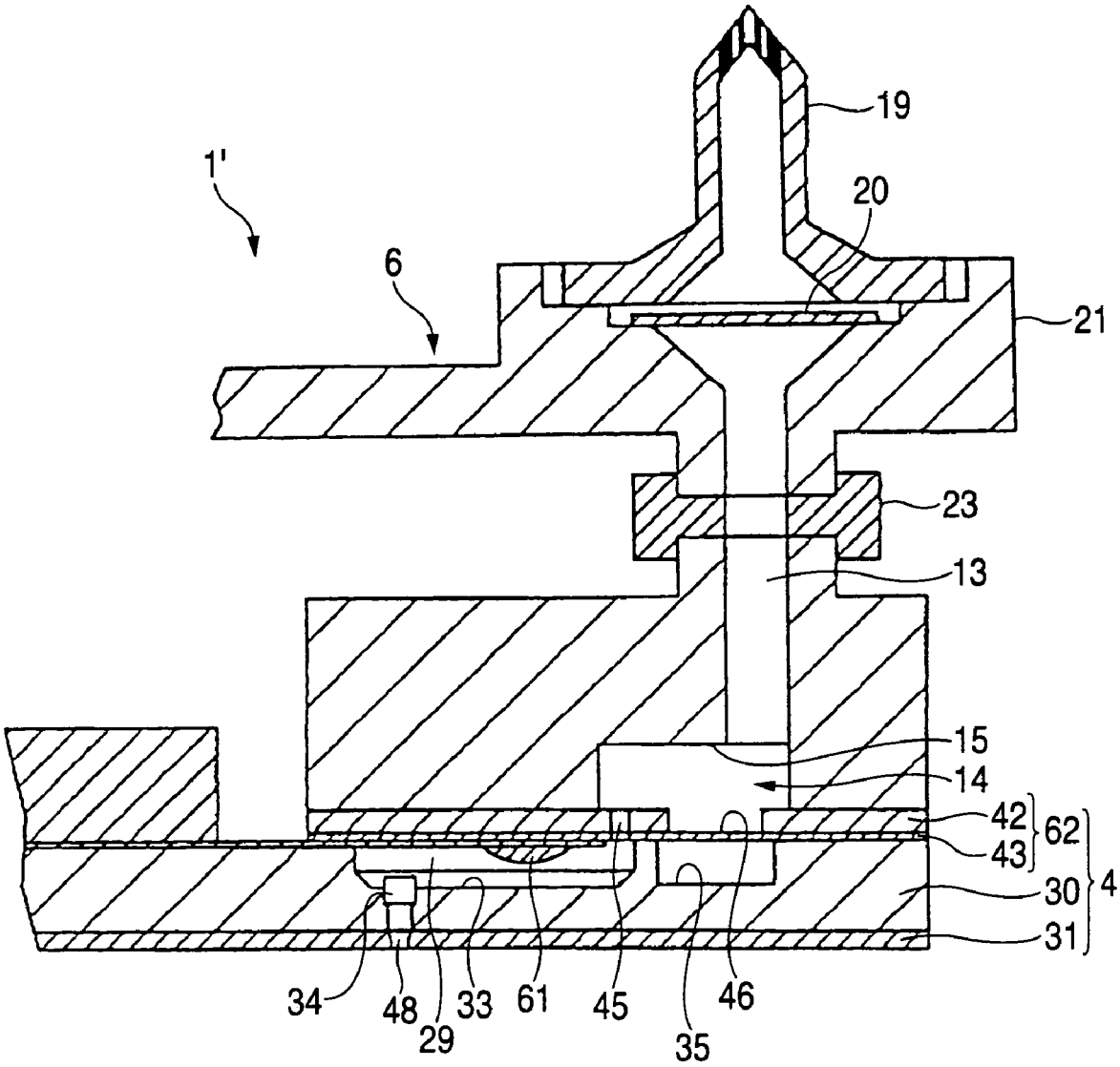
FIG. 29 is a sectional view for explaining an ink jet recording head according to a second example.

As a second example, a recording head 1' shown in FIG. 29 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A forging work method, comprising steps of:

providing a metallic plate member;

providing a first punch, operable to perform a first forging work to mold a first opening in the plate member;

providing a second punch, operable to perform a second forging work to mold a second opening in the plate member;

actuating the first punch up to a maximum stroke position thereof, while molding the first opening; and actuating the second punch, while keeping the first punch at the maximum stroke position;

wherein the second punch is kept off the plate member until the molding of the first opening is finished; and wherein a shape of the first opening is different from a shape of the second opening.

2. The forging work method as set forth in claim 1, wherein the first opening has a higher minuteness than the second opening.

3. The forging work method as set forth in claim 1, wherein the first forging work and the second forging work are performed on a single stage.

4. The forging work method as set forth in claim 1, wherein the second forging work is a perforating work.

5. The forging work method as set forth in claim 1, wherein the second opening comprises at least a positioning member to be used when the plate member is assembled with another member.

6. A forging work method, comprising steps of:

providing a metallic plate member;

providing a first punch, operable to perform a first forging work to mold a first member in the plate member;

providing a second punch, operable to perform a second forging work to mold a second member in the plate member;

actuating the first punch up to a maximum stroke position thereof, while molding the first member; and actuating the second punch, while keeping the first punch at the maximum stroke position;

wherein the first forging work includes a first work for preforming the first member and a second work for finishing the first member; and the second forging work is performed after the second work of the first forging work.

7. The forging work method as set forth in claim 6, further comprising a predetermined delay between the beginning of the second work of the first forging work and the beginning of the second forging work.

8. A forging work method, comprising steps of:

providing a metallic plate member;

providing a first punch, operable to perform a first forging work to mold a first opening in the plate member, the first opening has a first function; and providing a second punch, operable to perform a second forging work to mold a second opening in the plate member, the second opening including at least one kind of positioning member;

wherein the first forging work and the second forging work are performed at a single stage;

wherein a predetermined delay is provided between the end of the first forging work and the beginning of the second forging work;

wherein the second punch is kept off the plate member until the first forging work is finished; and wherein a shape of the first opening is different from a shape of the second opening.

9. The forging work method as set forth in claim 8, wherein the first opening is molded before the second opening is molded.

10. The forging work method as set forth in claim 9, wherein:

the first punch is first actuated up to a maximum stroke position thereof, while molding the first opening; and the second punch is actuated, while keeping the first punch at the maximum stroke position.

11. The forging work method as set forth in claim 8, wherein the first opening is provided as recesses, and the positioning member is provided as at least two through holes.

12. The forging work method as set forth in claim 11, wherein the recesses are arranged at a fixed pitch.

13. The forging work method as set forth in claim 12, wherein the fixed pitch is 0.3 mm or less.

14. The forging work method as set forth in claim 8, wherein the metallic plate member is comprised of nickel.

15. The forging work method as set forth in claim 11, wherein the first opening and the second opening are arranged as close as possible.

16. The forging work method as set forth in claim 14, further comprising a predetermined delay between actuating the first punch up to a maximum stroke position and actuating the second punch.

17. A forging work method, comprising steps of:

providing a metallic plate member;

providing a first punch, operable to perform a first forging work to mold a first member in the plate member, the first member has a first function; and providing a second punch, operable to perform a second forging work to mold a second member in the plate member, the second member including at least one kind of positioning member;

wherein the first forging work and the second forging work are performed at a single stage;

wherein a predetermined delay is provided between the end of the first forging work and the beginning of the second forging work;

wherein the first member is molded before the second member is molded;

wherein the first punch is first actuated up to a maximum stroke position thereof, while molding the first member;

wherein the second punch is actuated, while keeping the first punch at the maximum stroke position;

wherein the first forging work includes a first work for preforming the first member and a second work for finishing the first member; and wherein the second forging work is performed after the second work of the first forging work.

18. A forging work method, comprising steps of:

providing a metallic plate member;

providing a first punch, operable to perform a first forging work to mold a first opening in the plate member;

providing a second punch, operable to perform a second forging work to mold a second opening in the plate member;

actuating the first punch up to a maximum stroke position thereof, while molding the first opening; and actuating the second punch, while keeping the first punch at the maximum stroke position;

wherein said first forging work forms a plurality of substantially parallel recesses; and wherein a shape of the first opening is different from a shape of the second opening.

19. A forging work method, comprising steps of:

providing a metallic plate member;

providing a first punch, operable to perform a first forging work to mold a first member in the plate opening, the first opening has a first function; and providing a second punch, operable to perform a second forging work to mold a second opening in the plate member, the second opening including at least one kind of positioning member;

wherein the first forging work and the second forging work are performed at a single stage;

wherein a predetermined delay is provided between the end of the first forging work and the beginning of the second forging work; and wherein said first forging work forms a plurality of substantially parallel recesses; and wherein a shape of the first opening is different from a shape of the second opening.

* * * * *